US006852460B2

(12) United States Patent
Nakayama et al.

(10) Patent No.: US 6,852,460 B2
(45) Date of Patent: Feb. 8, 2005

(54) TONER AND IMAGE FORMING METHOD USING THE SAME

(75) Inventors: Yukinori Nakayama, Watarai-gun (JP); Yojiro Sato, Watarai-gun (JP); Hiroaki Moriyama, Watarai-gun (JP); Masaki Ishii, Watarai-gun (JP); Noriya Okamoto, Watarai-gun (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/131,284

(22) Filed: Apr. 23, 2002

(65) Prior Publication Data

US 2003/0186151 A1 Oct. 2, 2003

(30) Foreign Application Priority Data

| | | |
|---|---|---|
| Apr. 23, 2001 | (JP) | 2001-124985 |
| Apr. 23, 2001 | (JP) | 2001-124987 |
| Apr. 23, 2001 | (JP) | 2001-124988 |
| Apr. 23, 2001 | (JP) | 2001-124989 |
| Apr. 23, 2001 | (JP) | 2001-124990 |
| Apr. 23, 2001 | (JP) | 2001-124991 |
| May 28, 2001 | (JP) | 2001-159641 |

(51) Int. Cl.[7] ..... G03G 9/08
(52) U.S. Cl. ..... 430/108.6; 430/106.1
(58) Field of Search ..... 430/108.6, 106.1, 430/108.5, 106.2, 111.4, 109.1

(56) References Cited

U.S. PATENT DOCUMENTS

| | | | | | |
|---|---|---|---|---|---|
| 4,983,488 | A | * | 1/1991 | Tan et al. | 430/137.14 |
| 5,034,298 | A | | 7/1991 | Berkes et al. | |
| 5,981,132 | A | * | 11/1999 | Kurose et al. | 430/108.11 |
| 6,203,955 | B1 | * | 3/2001 | Mochizuki | 430/108.6 |
| 6,348,291 | B1 | * | 2/2002 | Sato | 430/108.6 |
| 6,383,704 | B1 | * | 5/2002 | Kataoka et al. | 430/108.6 |
| 2001/0053491 | A1 | * | 12/2001 | Arai | 430/108.6 |

FOREIGN PATENT DOCUMENTS

| | | | | | |
|---|---|---|---|---|---|
| JP | 52-135739 | | | 11/1977 | |
| JP | 62-113158 | | | 5/1987 | |
| JP | 64-62667 | | | 3/1989 | |
| JP | 2-134648 | | | 5/1990 | |
| JP | 4-358164 | | | 12/1992 | |
| JP | 4-358165 | | | 12/1992 | |
| JP | 5-80582 | | | 4/1993 | |
| JP | 5-181306 | | | 7/1993 | |
| JP | 5-188633 | | | 7/1993 | |
| JP | 7-77829 | | | 3/1995 | |
| JP | 10-3177 | | | 1/1998 | |
| JP | 200128534 | A | * | 5/2000 | C01G/23/04 |
| JP | 2000-128534 | | | 5/2000 | |
| JP | 2001125302 | A | * | 5/2001 | G03G/9/08 |

OTHER PUBLICATIONS

Diamond, Arthur S. (editor) Handbook of Imaging Materials. New York: Marcel–Dekker, Inc. (1991) pp. 164 & 168–171.*

Klein, Cornelis et al. Manual of Mineralogy. New York: John Wiley & Sons. (1985) pp. 304 & 305.*

* cited by examiner

*Primary Examiner*—Christopher Rodee
(74) *Attorney, Agent, or Firm*—Joel Lutzker; Reine H. Glanz; Schulte Roth & Zabel

(57) ABSTRACT

A toner, such as an electrostatic latent image developing toner and a MICR toner, has an even charge distribution, and exhibits balanced charging characteristics without decreases in frictional electrification or increases in charge, as well as superior fluidity, environmental independence, and durability. This is achieved by treating toner particles, which include binder resin and magnetic particles, with an external additive particle that is one of: a combination of rutile-type titanium oxide and anatase-type titanium oxide; and rutile-type titanium oxide that falls in a range of 5 to 10% by volume when a total volume of the toner is regarded as being 100%.

14 Claims, 31 Drawing Sheets

TONER AND IMAGE FORMING METHOD USING THE SAME

TECHNICAL FIELD

The present invention relates to a present toner and an image forming method using the same. In particular, the present invention relates to an electrostatic latent image developing toner used in an electrophotographic method or the like, a magnetic ink character recognition (hereafter, "MICR") toner that is used to print images which are subjected to MICR, and to an image forming method that uses such toners.

BACKGROUND ART

In a dry electrophotography method, the toner particles used when converting (i.e., developing) an electrostatic latent image to form a visible image are normally formed by (i) premixing a thermoplastic binding resin (hereafter "binder resin"), a charge controlling agent, magnetic particles, and an external additive particle, (ii) melting and kneading the mixture, (iii) pulverizing the result, and (iv) classifying the resultant particles to form toner particles having a desired particle diameter. After this process, frictional electrification is performed to accumulate a predetermined amount of positive or negative charge on the surfaces of these toner particles, with the charged particles being used to develop an electrostatic latent image.

The electric charge that accumulates on the surfaces of the toner particles due to the frictional electrification performed here needs to be either positive or negative depending on the type of photoconductive photosensitive roll used to form an electrostatic latent image. Sufficient charge needs to be accumulated during the frictional electrification so that the electrostatic latent image can be properly developed to form a visible image. For these reasons, it is commonplace to mix and disperse a charge controlling agent and a conductive substance into binder resin so as to control the polarity of the charge and the amount of charge that accumulates on the surfaces of the toner particles, with inorganic fine powders, such as silica, aluminum oxide, titanium oxide and zinc oxide, usually being added for this purpose. However, as such inorganic fine powders are usually hydrophilic, there is the problem that the charging characteristics of the toner particles vary greatly with environmental conditions such as humidity.

The effects of environmental conditions such as those described above are conventionally countered by treating the surfaces of particles of these inorganic fine powders with a hydrophobic agent or by introducing a polar functional group.

As one example, JP 52-135739A discloses a technology that uses a metal oxide, which has been surface-treated with an amino-silane coupling agent, to introduce a polar functional group. JP 10-3177A discloses a toner where a titanium compound formed by a reaction between $Ti(OH)_2$ with a silane coupling agent is used as an external additive particle. JP 5-181306A discloses an electrostatic latent image developer where fine particles of an abrasive agent, such as alumina or zirconia, are fixed to the surfaces of toner core particles and the ratio of the particle diameter of the toner core particles to the particle diameter of the fine abrasive agent particles is controlled. With this kind of electrostatic latent image developer, a superior abrasive effect is achieved for the surface of a photosensitive roll, so that a large cleaning mechanism such as a cleaning brush does not need to be used. As a result, image forming apparatuses can be made smaller, with there also being additional benefits regarding blurring phenomena, image density, and background printing (fogging).

However, as the amino-silane coupling agent is hydrophilic, the developed disclosed by JP 52-135739A suffers from a dramatic fall in fluidity and charging characteristics when used in high temperature and high humidity environment. As for the titanium compound disclosed as an external additive particle in JP 10-3177A, the average particle diameter of the titanium compound is extremely small, so that the compound is susceptible to coagulation, making it difficult to handle. As the abrasive effect is also poor, an extreme increase in charge occurs, thereby increasing the likelihood of problems such as decreases in image density, background printing, and blurring phenomena. With the electrostatic latent image developer disclosed in JP 5-181306A, while a desired abrasive effect can be achieved for the surface of the photosensitive roll, the charging characteristics are unstable, and the durability of the toner has not always been satisfactory.

JP 62-113158A, JP 64-62667A, and JP 5-188633A disclose toners to which hydrophobic silica and (anatase-type) titanium oxide have been added. However, with such toners, friction results in the (anatase-type) titanium oxide becoming embedded in the toner particles, which results in the problem of the charging characteristics becoming unstable.

JP 2000-128534A discloses a toner to which hydrophobic titanium oxide is added. This hydrophobic titanium oxide is formed by treating the surfaces of (i) hydrous titanium oxide, and/or (ii) rutile-type titanium oxide that includes some anatase-type titanium oxide, with a silane coupling agent. The hydrophobic titanium oxide is prevented from becoming embedded inside the toner particles by setting the major axis diameter of the hydrophobic titanium oxide in a range of 0.02 to 0.1 $\mu$m and the axial ratio in a range of 2 to 8. However, such hydrophobic titanium oxide is difficult to manufacture, has a low bulk density and is difficult to form with stable charging characteristics.

To the contrary in recent years, recognition marks called "fonts" have been used on checks, securities, bills, tickets, etc, to prevent forgery and tampering. Forgery prevention technologies that use fonts are normally referred to as "MICR (Magnetic Ink Character Recognition) systems", with examples of such being disclosed by JP 2-134648A, JP 5-80582A, and U.S. Pat. No. 5,034,298. In more detail, recognition marks that are made up of such fonts are composed of combinations of numbers and symbols, and are printed on the surfaces of checks and the like to prevent forgery. These recognition marks composed of fonts are formed using a magnetic ink in which a predetermined amount of magnetic particles has been dispersed in a binder. As a result, by using the magnetism of the magnetic particles, it is possible to judge whether the checks or the like are genuine or fake from information outputted by a specialized reader that reads the fonts in the recognition marks. These recognition marks composed of fonts are visible to the human eye, so that an initial judgement as to whether the stamps, etc. are genuine can be made by simply looking at them. As a result, unlike barcodes, for example, there is the advantage that a simple and fast judgement can be made before the specialized reader is used. As examples, a screen printing method or a gravure printing method can be used to print fonts using the magnetic ink, though in recent years more attention is being paid to using printers as an easy and fast way of printing fonts. When a printer is used to form an image with a magnetic ink, the magnetic ink used is usually referred to as a "MICR toner" or a "MICR printer magnetic toner". MICR toners are usually composed of (1) MICR toner particles that are made up of (i) the binder resin composed of a thermoplastic resin, (ii) a wax or a wax derivative as a surface lubricant, (iii) magnetic particles, (iv) an inorganic powder, etc., and (2) an external additive particle. In more detail, the above materials are evenly kneaded, and then pulverized and classified to form MICR toner particles. A process to add external additive particles, such as silica and an abrasive agent, is then performed to finally form one type of toner whose average particle diameter is in a range of around 4 to 15 $\mu$m. However with a conventional MICR toner, the residual magnetism has to be sufficiently high for reading to be performed successfully, so that the charge distribution of the remaining toner in a developing apparatus becomes broader as the printing operations are repeatedly and long performed. This results in problems such as a decrease in image density, increased probability of background printing, and a high incidence of read errors for the recognition marks are formed.

For this reason, JP 4-358164A, JP 4-358165A, and JP 7-77829A disclose MICR toners that include a binder resin (polyolefin resin) and magnetic particles and have two types of magnetic particles mixed with and dispersed in the binder resin. In more detail, the presence of two types of magnetic particles in these MICR toners results in the residual magnetism being kept within a range of 4.0 to 7.0 emu/g. However, it is not possible to raise the residual magnetism of a MICR toner by simply combining two types of magnetic particles, and if the residual magnetism of the MICR toner is kept within a range of 4.0 to 7.0 emu/g, problems such as a high incidence of read errors are still observed.

For this reason, by performing a through investigation of the problems with the conventional technology, the inventors of the present invention found that it is possible to overcome the problems that were observed for conventional toners by 1. causing interacting effects by adding anatase-type titanium oxide to improve abrasion and adding rutile-type titanium oxide to sharpen the charge distribution, or
2. adding an amount of rutile-type titanium oxide so that the specific volume of rutile-type titanium oxide falls in a specific range.

These techniques constitute the present invention.

In other words, it is an object of the present invention to provide (i) a toner which exhibits stable charging characteristics with an even charge distribution, no decrease in frictional electrification or increase in charging ability with time/use, and has excellent fluidity, environmental independence, and durability, and (ii) an image forming method that uses the toner.

DISCLOSURE OF THE INVENTION

According to the present invention, the above problems are solved by using a toner in which toner particles, which include binder resin and magnetic particles, are treated with an external additive particle that is one of: a combination of rutile-type titanium oxide and anatase-type titanium oxide; and rutile-type titanium oxide that falls in a range of 5 to 10% by volume when a total volume of the toner is regarded as being 100%.

In this toner, the presence of the anatase-type titanium oxide results in the toner having superior fluidity, environmental independence, and durability. The presence of the rutile-type titanium oxide results in the toner exhibiting balanced charging characteristics with an even charge distribution and without decreases in frictional electrification or increases in charge with time or use.

On the other hand, by adding a predetermined amount of rutile-type titanium oxide, it is possible to form a toner that has superior fluidity and environmental independence, as well as balanced charging characteristics without increases in charge with time or use.

A different aspect of the present invention provides an image forming method by which an image forming apparatus forms an image using a toner, the image forming apparatus including an image carrier that uses a charged-type photosensitive roll, a developing means for developing an image on the image carrier without touching the image carrier, a transfer means for transferring the developed image formed on the image carrier, and a cleaning means for collecting toner that remains on the image carrier, a toner in which toner particles, including binder resin and magnetic particles, are treated with a combination of rutile-type titanium oxide and anatase-type titanium oxide being used as the toner.

With the above image forming method according to the present invention, the interacting effects of the anatase-type titanium oxide and the rutile-type titanium oxide effectively prevent the toner marking in the defined area and blurring phenomena from occurring over the long term, especially in the case where images are formed using a positive-charging organic photosensitive roll.

BEST MODE FOR CARRYING OUT THE INVENTION

First Embodiment

Figure 1:
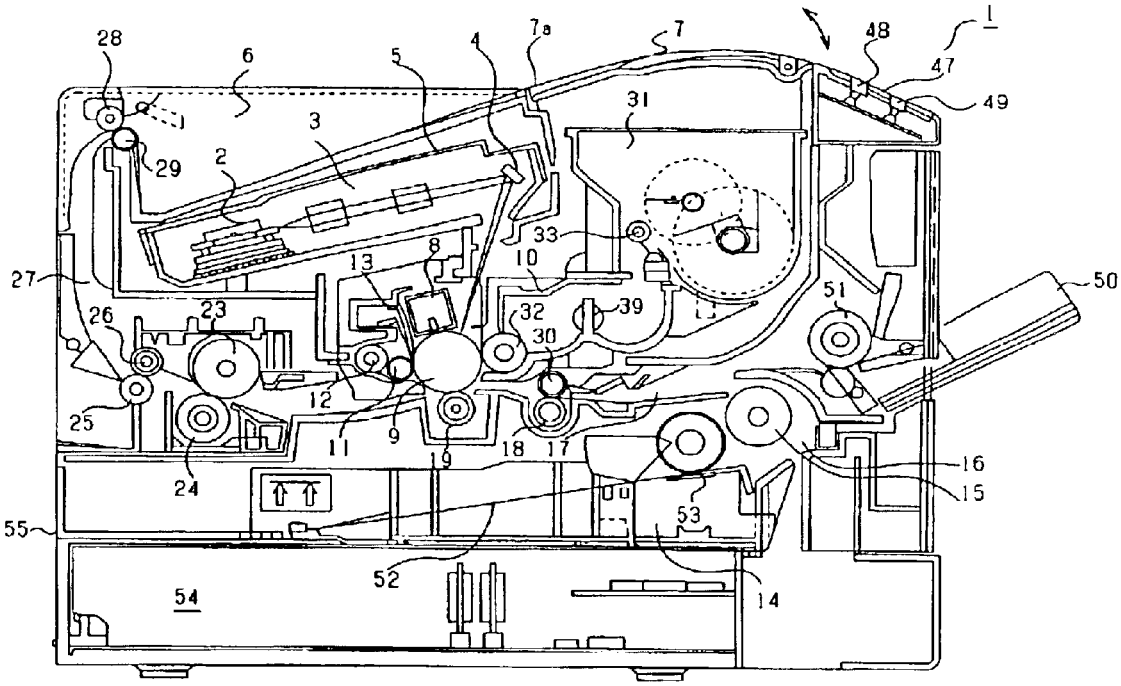
FIG. 1 is a cross-sectional figure showing an image forming apparatus in which a toner according to the present invention is used.

The first embodiment of the present invention is a toner that is characterized by having toner particles, which include a binder resin and magnetic particles, treated with an external additive particles that is one of (a) a combination of rutile-type titanium oxide and anatase-type titanium oxide and (b) rutile-type titanium oxide that falls in a range of 5 to 10% by volume when a total volume of the toner is regarded as being 100%. In the following explanation, the toner particles and the external additive paticles are described separately.

1. Toner Particles (1) Binder Resin (i) Types

There are no special restrictions regarding the type of binder resin used in the toner of the present invention. It is preferable to use a thermoplastic resin, with examples of such being a styrene resin, an acrylic resin, a styrene-acrylic copolymer, a polyethylene resin, a polypropylene resin, a polyvinyl chloride resin, a polyester resin, a polyamide resin, a polyurethane resin, a polyvinyl alcohol resin, a vinyl ether resin, a N-vinyl resin, and a styrene-butadiene resin. In more detail, it is desirable to use a polystyrene resin or a polyester resin. Here, a homopolymer of a styrene monomer or a copolymer composed of a styrene and a copolymerized monomer may be used as the polystyrene resin. Examples of a preferable copolymerized monomer include one or a combination of two or more of: ethylene unsaturated mono olefin and its derivatives; vinyl halide; vinyl ester and its derivatives; acrylic acid ester or methacrylic acid ester; acrylic acid derivatives, and N-vinyl compounds. Also, as the polyester resin, any resin formed by condensation polymerization of an alcohol component and a carboxylic acid component can be favorably used, or co-condensation polymerization of the similar component (ii) Molecular Weight Distribution It is also preferable for the binder resin to be such that when the weight-average molecular weight (Mw) is measured by gel permeation chromatography (GPC), there are both two molecular weight distribution peaks (a low molecular weight peak and a high molecular weight peak) or each.

Using specific numbers, it is preferable to use a binder resin that has a low molecular weight peak in a range of 3,000 to 20,000 and a high molecular weight peak in a range of $3\times10^4$ to $15\times10^5$. The reason for this is that when the low molecular weight peak is in the first stated range, the fixing characteristics of the toner are improved, while when the high molecular weight peak is in the second stated range, the offsetting characteristics of the toner are improved. When the low molecular weight peak is below 3,000, for example, offsetting tends to occur during fixing, and there is a decrease in stability during storage for a utilization environment temperature range for the toner of 5 to 50° C., so that problems such as caking are likely to occur. On the other hand, when the low molecular weight peak is above $15\times10^5$, for example, there is a decrease in compatibility between the binder resin and the charge controlling agent, so that there can be cases where even dispersion cannot be achieved, as well as other problems such as background printing, contamination of the photosensitive roll and poor adhesion of the toner to the carrier.

Also, it is preferable for the binder resin to be such that the ratio (Mw/Mn) of the weight-average molecular weight (Mw) to the number-average molecular weight (Mn) is 10 or above.

The reason for this is that when the ratio (Mw/Mn) is below 10, there are cases where there is a decrease in the fixing and offsetting characteristics of the toner, so that there can be cases where a satisfactory level cannot be achieved for these characteristics.

(iii) Crosslinking Structure

As favorable fixing characteristics can be achieved, it is preferable for a thermoplastic resin to be used as the binder resin, though when a hardening resin is used, it is preferable for the amount of crosslinking component (amount of gel) as measured by a Soxhlet extractor to be no greater than 10% by weight, and more preferably to be in a range of 0.1 to 10% by weight. By introducing this kind of crosslinking structure, improvements can be made to the storage stability, form-retaining ability, and durability of the toner without causing deterioration in the fixing characteristics. Accordingly, it is not necessary to use 100% by weight of the thermoplastic resin as the binder resin, and a crosslinking agent may be added and/or a certain amount of a thermal the hardening resin may be used.

As examples, an epoxy resin and a cyanate resin may be used as the thermal hardening resin, with more examples being a single resin or combination of two or more resins selected from bisphenol A-type epoxy resin, a hydrogenated bisphenol A-type epoxy resin, a novolak-type epoxy resin, a polyalkylene ether-type epoxy resin, a cyclic aliphatic-type epoxy resin, and a cyanate resin.

(iv) Functional Group

In order to improve the dispersion of the magnetic particles in the binder resin, it is preferable to introduce a function group. As one example, at least one of a hydroxy group, a carboxyl group, an amino group and a glycidoxy (epoxy) group may be added as the functional group.

It should be noted that it can be confirmed whether the binder resin includes these functional groups using an FT-IR (Fourier Transform Infrared) apparatus, and the included amounts of such functional groups can be measured through titrimetry.

(v) Glass Transition Point

It is desirable for the glass transition point of the binder resin to be a value in a range of 55 to 70° C. When the glass transition point of the binder resin is below 55° C., there are cases where the resultant toner particles fuse together, which results in poor storage stability for the toner. On the other hand, when the glass transition point of the binder resin is above 70° C., there are cases where the fixing characteristics of the toner are poor. Accordingly, it is more desirable for the glass transition point of the binder resin to be a value in a range of 58 to 68° C., with a value in a range of 60 to 66° C. being even more desirable.

It should be noted that the glass transition point of the resin can be found, using a differential scanning calorimeter (DSC), from the point at which the specific heat capacity changes.

(vi) Softening Point

When the binder resin exhibits crystallinity, it is preferable for the softening point (or melting point) to be a value in a range of 110 to 150° C. The reason for this is that when the softening point (or melting point) of the binder resin is below 110° C., there are cases where toner particles fuse together, which results in poor storage stability. On the other hand, when the softening point (or melting point) of the binder resin is above 150° C., there are cases where there is a dramatic deterioration in the fixing characteristics of the toner. Accordingly it is more desirable for the softening point (or melting point) of the binder resin to be in a range of 115 to 145° C., with a value in a range of 120 to 140° C. being even more desirable.

Note that the softening point (or melting point) of the binder resin may be found using the falling ball method or from the melting peak position that can be measured using a DSC.

(2) Wax and Wax Derivatives

Improved fixing characteristics, offsetting characteristics, and a reduction in read errors for a reader are sought for the toner of the present invention, so that it is preferable for a wax or a wax derivative to be added. There are no particular restrictions regarding the type of wax or wax derivative, though as examples, one or a combination of two or more of the following may be used: a polyethylene wax; a polypropylene wax; a Teflon wax; a Fischer-Tropsch wax; a paraffin wax; ester wax; a montan wax; and a rice wax. It should be noted that Fischer Tropsch wax is defined as being a normal hydrocarbon compound formed using the Fischer-Tropsch reaction (which is a catalytic hydrogenating reaction of carbon monoxide) and has few iso construction molecules and side chains. Among Fischer-Tropsch waxes, it is preferable to use a wax that has a weight-average molecular weight of 1,000 or above and an endothermic bottom peak (as measured by a DSC) in a range of 100 to 120° C. Examples of such Fischer-Tropsch waxes are the Sasol Wax C1 (high molecular weight grade due to the crystallization of H1, endothermic bottom peak=106.5° C.), the Sasol Wax C105 (formed by the fractional distillation of C1, endothermic bottom peak=102.1° C.), and the Sasol Wax Spray (fine particles of C105, endothermic bottom peak=102.1° C.) that can be obtained from Sasol.

There are no particular restrictions regarding how much wax and wax derivatives is added, but if the entire weight of the toner is set at 100% by weight, for example, it is preferable for the added amount to be in a range of 1 to 5% by weight. The reason for this is that when the added amount of wax and wax derivatives is less than 1% by weight, there is a decrease in the offsetting characteristics of the toner, so that there are cases where it is not possible to effectively stop smearing occurring in the image. On the other hand, when the added amount of wax and wax derivatives is above 5% by weight, there are cases where toner particles fuse together, which results in poor storage stability for the toner.

(3) Charge Controlling Agent

It is preferable for a charge controlling agent to be added to the toner of the present invention as this results in a remarkable improvement in the charging level and charging initiation characteristics (an index showing whether a predetermined charging level can be reached in a short time) and in other properties such as superior durability and stability. There are no particular restrictions regarding the type of charge controlling agent that can be added, but as examples, the following charge controlling agents that exhibit positive charging characteristics or negative charging characteristics may be used.

(i) Positive Charge Controlling Agents

Nigrosine compounds, quaternary ammonium salts, and resinous charge controlling agents where an amine compound has been combined with a resin are examples of positive charge controlling agents. Of these, the use of a nigrosine compound, for example, results in faster charging initiation characteristics, making this a favorable positive charge controlling agent for a positive charging toner. Alternatively, a resin or oligomer including a quaternary ammonium salt, a resin or oligomer including a carboxylate, and a resin or oligomer including a carboxyl group may be used. In particular, a styrene-acrylic resin (a styrene-acrylic co-polymer) including a quaternary ammonium salt, a carboxylate, or a carboxylate group as a functional group is a favorable positive charge controlling agent as it is easy to adjust the charge-to-mass ratio so as to fall within a desired range.

(ii) Negative Charge Controlling Agents

As examples, an organometallic complex or a chelate compound such as a monoazo metallic complex, an acetyl acetone metallic complex, and an aromatic hydroxyl carboxylate- or an aromatic hydroxyl dicarboxylate-metal complex can be effectively used as a negative charge controlling agent. As alternatives, aromatic hydroxyl carboxyl acid, aromatic mono- or poly-carboxyl acid or a metal salt of these acids, an anhydride, an ester, or a phenol derivative such as bisphenol may be used.

(iii) Added Amount

If the entire weight of the toner is set at 100% by weight, it is preferable for the added amount of charge controlling agent to fall in a range of 1.5 to 150% by weight. The reason for this is that if the added amount of charge controlling agent is below 1.5% by weight, it is difficult to stabilize the charging characteristics of the toner, so that there can be cases where there is a decrease in image density and/or a decrease in durability. The toner is also susceptible to problems regarding dispersion, which can lead to background printing and/or increased contamination of the photosensitive roll.

On the other hand, when the added amount of charge controlling agent is above 15% by weight, there are cases where the toner becomes more environmentally dependent. In particular, at high temperatures and high humidity, there are cases where there is an increased incidence of problems such as a deterioration in charging characteristics, a deterioration in image quality, and contamination of the photosensitive roll. As a result, to achieve a favorable balance between the charge controlling function and factors such as the durability of the toner, it is more preferable for the added amount of charge controlling agent to be in a range of 2.0 to 8.0% by weight, with a value in a range of 3.0 to 7.0% by weight being even more favorable.

(4) Magnetic Particles (i) Types

It is also preferable for magnetic particles to be added to the toner to control the charging characteristics. As examples, magnetic particles that have iron oxide (magnetite), iron powder, cobalt powder, nickel powder, or ferrite powder as their major constituent and magnetic particles such as iron oxide (magnetite) that has been doped with a strongly magnetic metal such as cobalt or nickel can be used. As the magnetic particles, it is also possible to use an alloy that does not contain a fundamentally strongly magnetic element but exhibits strong magnetism after being subjected to an appropriate heat treatment, such as chromium dioxide and the like. It is also preferable for the magnetic particles to be subjected to a surface treatment using a coupling agent such as a titanate coupling agent or a silane coupling agent. The reason for this is that by subjecting the magnetic particles to a surface treatment results in an improvement in the compatibility of the magnetic particles with the binder resin and in a more even dispersion of the magnetic particles in the binder resin. As magnetic particles are normally hydrophilic, performing this kind of surface treatment results in a suitable improvement in the hydrophobic property of the toner, thereby making the toner more resistant to moisture.

(ii) Average Particle Diameter

It is preferable for the average particle diameter of the magnetic particles to fall in a range of 0.1 to 0.5 $\mu$m. The reason for this is that by setting the average particle diameter of the magnetic particles outside this range results in problems such as an uneven dispersion of the magnetic particles in the toner particles and a difficulty in evenly charging the toner particles. Consequently, it is more preferable for the average particle diameter of the magnetic particles to fall in a range of 0.15 to 0.45 $\mu$m, with it being even more preferable for the average particle diameter to fall in a range of 0.2 to 0.4 $\mu$m.

(iii) Added Amount

When a one-component developing method is used, the added amount of magnetic particles should preferably fall in a range of 30 to 70% by weight added to the total weight of the toner particles. The reason for this is that when the added amount of magnetic particles is below 30%, there are cases where there is a decrease in durability and a susceptibility to background printing. On the other hand, when the added amount of magnetic particles is above 70%, there can be cases where there is deterioration in image density and durability, and a remarkable fall in the fixing characteristics. Accordingly, when a one component developing method is used, it is more preferable for the added amount of magnetic particles to fall in a range of 30 to 60% by weight.

On the other hand, when a two-component developing method is used, a carrier is included, so that there is no need to add magnetic particles. When magnetic particles are added, however, it is preferable for the added amount of magnetic particles to be 15% or below by weight added to the total weight of the toner particles. The reason for this is that when the added amount of magnetic particles is above 15% by weight, there are cases where there is a decrease in durability and a susceptibility to background printing. Consequently, when a two component developing method is used, it is more preferable for the added amount of magnetic particles to fall in a range of 0 to 10% by weight (so long as the added amount is not 0% by weight).

(5) Modifier

In order to improve the fluidity and storage stability of the toner, it is preferable for a substance such as colloidal silica or hydrophobic silica to be added to the toner particles of the present invention as a modifier, or for the toner particles to be subjected to a surface treatment using such colloidal silica. It is preferable for the added amount of such silica to be determined with consideration to the added amount of titanium oxide. In more detail, the added amount of silica should preferably fall in a range that is 10 to 100% by weight when the added amount of titanium oxide represents 100% by weight. The reason for this is that when the added amount of silica is below 10% by weight, there are cases where adding silica has no significant effect. On the other hand, when the added amount of silica is above 100% by weight, there are cases where there is deterioration in the charging characteristics of an electrophotographic toner. Consequently, it is more preferable for the added amount of silica to fall in a range of 20 to 90% by weight when the added amount of titanium oxide represents 100% by weight, with it being even more preferable for the added amount to fall in a range of 30 to 80% by weight.

(6) Average Particle Diameter

It is preferable for the average particle diameter of the toner particles to fall in a range of 5 to 12 $\mu$m. The reason for this is that when the average particle diameter of the toner particles is below 5 $\mu$m, there are cases where there is a decrease in storage stability. On the other hand, when the average particle diameter of the toner particles is above 12 $\mu$m, there are cases where there is a decrease in transportability and where the fixed image is blurred. Consequently, it is more preferable for the average particle diameter of the toner particles to fall in a range of 6 to 11 $\mu$m.

2. External Additive Particles

According to the present invention, it is necessary to add both anatase-type titanium oxide and rutile-type titanium oxide to the toner particles in order to form a toner which (i) exhibits stable charging characteristics with an even charge distribution, no decrease in frictional electrification or charging ability with time/use, and (ii) has excellent fluidity, environmental independence, and durability. In more detail, anatase-type titanium oxide is added to increase abrasion and rutile-type titanium oxide is added to make the charge distribution sharper, with these effects interacting to achieve a multiplier effect.

(1) Anatase-Type Titanium Oxide (i) Average Particle Diameter

It is preferable for the average particle diameter of the anatase-type titanium oxide to be in a range such that the average particle diameter is at least 10 nm but is below 200 nm. The reason for this is that if the average particle diameter of the anatase-type titanium oxide is equal to or above 200 nm, there are cases where there may be damage to the photosensitive roll or where it is difficult to mix and disperse the magnetic ink particles with the toner particles. However, when the average particle diameter of the anatase-type titanium oxide is excessively small, such as when the average particle diameter is below 10 nm, there are cases where there is a decrease in the abrasive force that acts on the photosensitive roll and it is difficult to form a toner that has superior fluidity, environmental independence, and durability. Consequently, it is more preferable for the average particle diameter of the anatase-type titanium oxide to fall in a range of 120 to 180 nm.

(ii) Volume Resistivity

When the toner is used with an OPC (organic photoconductor) photosensitive roll, it is preferable for the volume resistivity of the anatase-type titanium oxide to fall in a range of $1\times10^4$ to $1\times10^{15}$ Ohm-cm. On the other hand, when the toner is used with an a-Si (amorphous silicon) photosensitive roll, it is preferable for the volume resistivity of the anatase-type titanium oxide to fall in a range of $1\times10^1$ to $1\times10^7$ Ohm-cm. The reason for this is that when the toner is used with an OPC photosensitive roll and the volume resistivity for anatase-type titanium oxide is outside the range given above, there are cases where there is deterioration in the charging characteristics of the toner which can cause a drop in the image density, resultant in white areas being left in the formed image. When the toner is used with an a-Si photosensitive roll and the volume resistivity for anatase-type titanium oxide is above $1\times10^7$ Ohm-cm, there are cases where the charge-to-mass ratio is too great, resultant in charging ability with time/use that conversely can cause a fall in the image density and in durability. When an a-Si photosensitive roll is used and there is an excessive increase in charge, discharge breakdown occurs, and there are cases where black spots appear in the image. Accordingly, when an OPC photosensitive roll is used, it is more preferable for the volume resistivity of the anatase-type titanium oxide to fall in a range of $1\times10^5$ to $1\times10^{14}$ Ohm-cm, with it being even more preferable for the volume resistivity to fall in a range of $1\times10^6$ to $1\times10^{13}$ Ohm-cm. When an a-Si photosensitive roll is used, it is more preferable for the volume resistivity of the anatase-type titanium oxide to fall in a range of $1\times10^2$ to $1\times10^6$ Ohm-cm, with it being even more preferable for the volume resistivity to fall in a range of $1\times10^3$ to $1\times10^5$ Ohm-cm.

It should be noted that the volume resistivity of anatase-type titanium oxide and rutile-type titanium oxide (described later) can be measured using an ultra high resistance meter (model number R8340A made by Advantest Corporation) by applying a 1 kg load and a DC voltage of 10V.

(iii) Surface Treatment

It is preferable for the anatase-type titanium oxide to be subjected to a surface treatment using a titanate coupling agent. A preferable titanate coupling agent is any one or combination of two or more of the following substances: propyl trimethoxy titanate; propyl dimethoxymethyl titanate; propyl triethoxy titanate; butyl trimethoxy titanate; butyl dimethoxymethyl titanate; butyl triethoxy titanate; vinyl trimethoxy titanate; vinyl dimethoxymethyl titanate; vinyl triethoxy titanate; vinyl diethoxymethyl titanate; hexyl trimethoxy titanate; hexyl dimethoxymethyl titanate; hexyl triethoxy titanate; hexyl diethoxy methyl titanate; phenyl trimethoxy titanate; phenyl dimethoxymethyl titanate; phenyl triethoxy titanate; phenyl diethoxy methyl titanate; y-glycidoxy propyl trimethoxy titanate; y-glycidoxy propyl trimethoxy methyl titanate; y-glycidoxy propyl triethoxy titanate; and y-glycidoxy propyl diethoxy methyl titanate.

It is also preferable, when anatase-type titanium oxide is surface-treated with a titanate coupling agent, for a mixer or ball mill to be used to evenly mix the anatase-type titanium oxide and the titanate coupling agent. It is also preferable to add an organic solvent such as methanol, ethanol, methyl ethyl ketone, or toluene, as this enables the anatase-type titanium oxide and the titanate coupling agent to be mixed even more evenly. It is preferable for the amount of titanate coupling agent used in the treatment to be fall a range of 0.1 to 50 parts per weight added to 100 parts per weight of anatase-type titanium oxide. It is more preferable for the amount to fall in a range of 0.5 to 30 parts per weight, and even more preferable for the amount to fall in a range of 1 to 10 parts per weight. When the anatase-type titanium oxide is subjected to surface treatment using the titanate coupling agent, it is preferable for a heat treatment to be performed. As one example, the anatase-type titanium oxide can be strongly surface-treated with the titanate coupling agent by performing a heat treatment for 1 to 60 minutes at a temperature of 50 to 300° C.

(iv) Degree of Coagulation

It is necessary to set the degree of coagulation of the anatase-type titanium oxide at below 10%. The reason for this is that if the degree of coagulation of the anatase-type titanium oxide is a value that is 10% or above, effective electrostatic adhesion to the toner particles is not achieved, with the anatase-type titanium oxide being susceptible to coming off the toner particles. Consequently, it becomes difficult for the effects of the anatase-type titanium oxide to be realized, resultant in problems such as deterioration in the image characteristics, a drop in the durability, and in the occurrence of blurring phenomena. Also, when the degree of coagulation of the anatase-type titanium oxide is 10% or above, the distribution of the charge becomes uneven, resultant in problems such as an increased incidence of background printing. Consequently, it is preferable for the degree of coagulation of the anatase-type titanium oxide to be 5% or below, with a degree of coagulation that is 1% or below being even more preferable.

Figure 14:
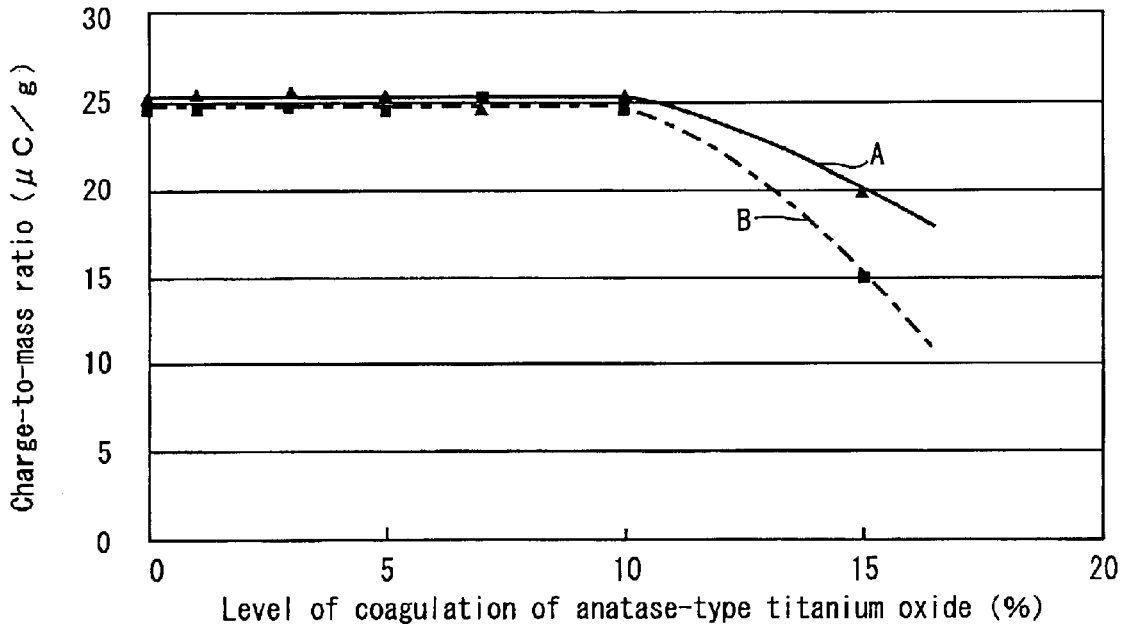
FIG. 14 shows, for an electrostatic latent image developing toner, the relationship between (i) the degree of coagulation of anatase-type titanium oxide and rutile-type titanium oxide and (ii) the charge-to-mass ratio of the resultant toner.
Figure 15:
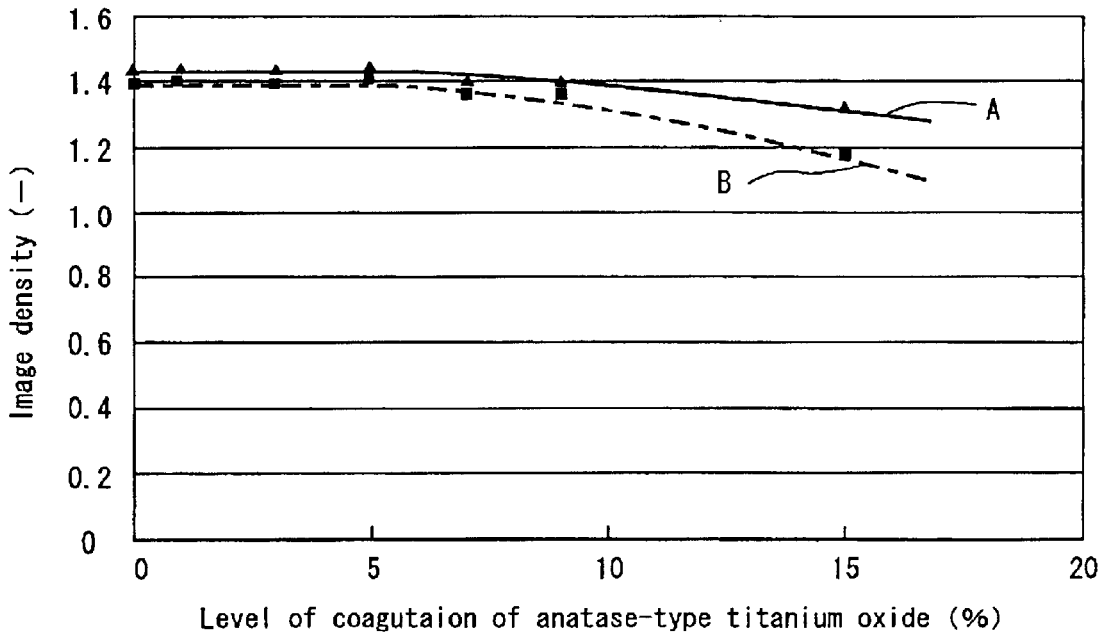
FIG. 15 shows, for an electrostatic latent image developing toner, the relationship between (i) the degree of coagulation of anatase-type titanium oxide and rutile-type titanium oxide and (ii) the image characteristics of the resultant toner.
Figure 16:
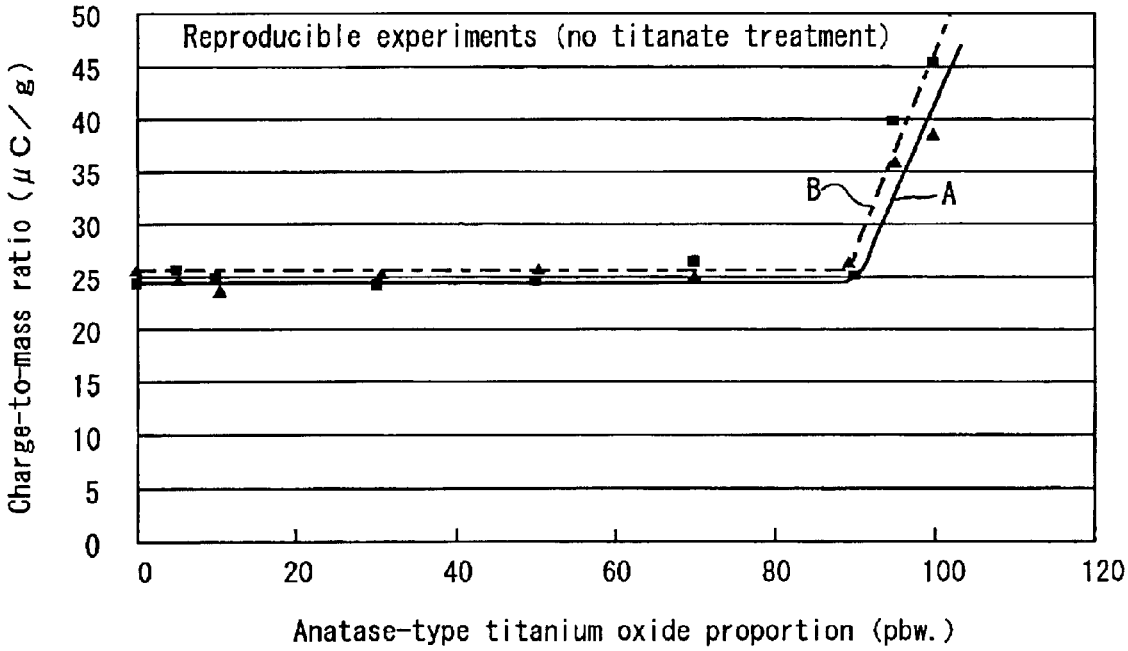
FIG. 16 shows, for an electrostatic latent image developing toner, the relationship (in reproducibility experiments) between (i) the added proportions of anatase-type titanium oxide and rutile-type titanium oxide and (ii) the charging characteristics.
Figure 17:
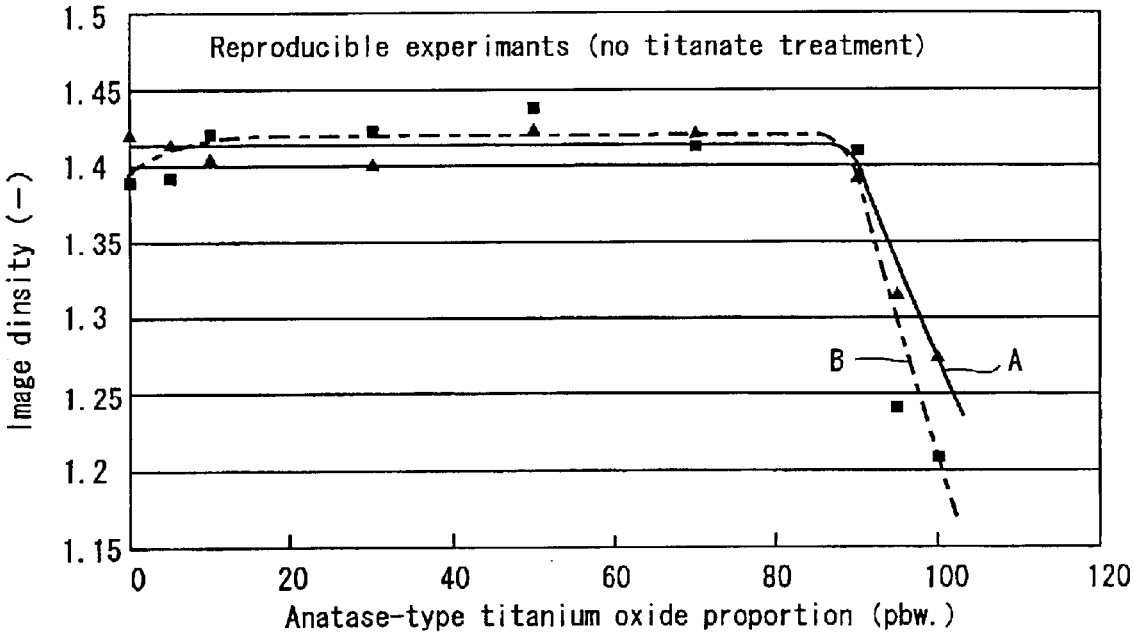
FIG. 17 shows, for an electrostatic latent image developing toner, the relationship (in reproducibility experiments) between (i) the added proportions of anatase-type titanium oxide and rutile-type titanium oxide and (ii) image density.
Figure 18:
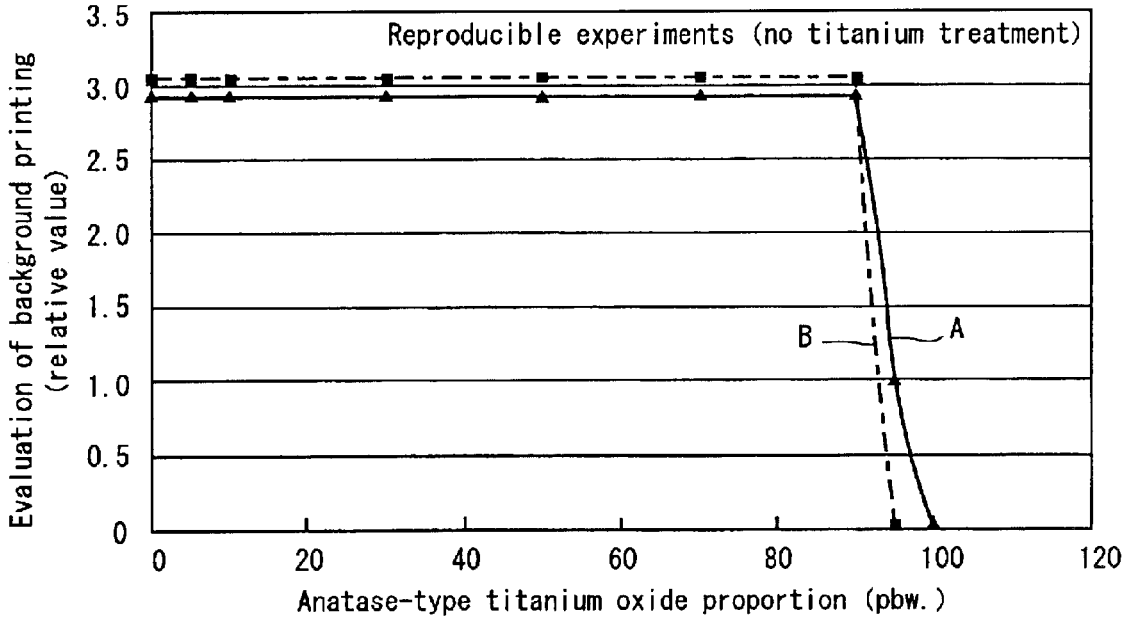
FIG. 18 shows, for an electrostatic latent image developing toner, the relationship (in reproducibility experiments) between (i) the added proportions of anatase-type titanium oxide and rutile-type titanium oxide and (ii) background printing.
Figure 19:
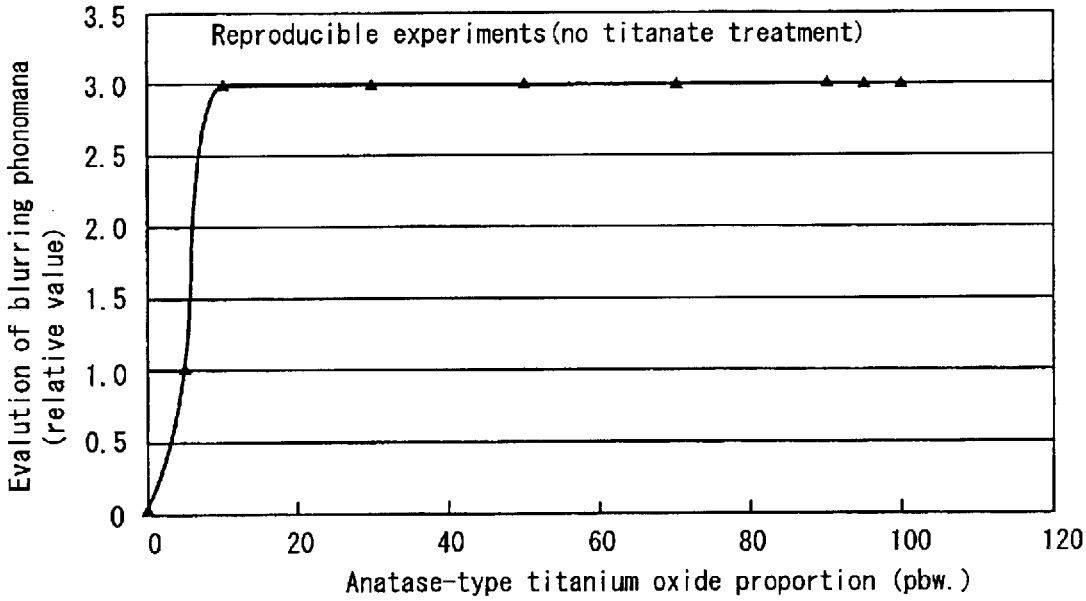
FIG. 19 shows, for an electrostatic latent image developing toner, the relationship (in reproducibility experiments) between (i) the added proportions of anatase-type titanium oxide and rutile-type titanium oxide and (ii) blurring phenomena.

The following describes, with reference to FIG. 14 and FIG. 15, the effects of the degree of coagulation of the anatase-type titanium oxide and the rutile-type titanium oxide. In FIG. 14, the horizontal axis shows the degree of coagulation (%) of the anatase-type titanium oxide and the rutile-type titanium oxide, while the vertical axis shows the charge-to-mass ratio ($\mu$C/g) for a latent image-developing toner that is obtained when such anatase-type titanium oxide and rutile-type titanium oxide are used.

In the same way, the horizontal axis in FIG. 15 shows the degree of coagulation (%) of the anatase-type titanium oxide and the rutile-type titanium oxide, while the vertical axis shows the image density (–) for a latent image-developing toner that is obtained when such anatase-type titanium oxide and rutile-type titanium oxide are used. It should be noted that in FIG. 14 and FIG. 15, the lines marked "A" show the initial values, while the lines marked "B" show the values after an endurance test has been performed.

As should be clear from FIG. 14 and FIG. 15, the characteristics of the resultant toner change noticeably with a boundary value of 100% for the degree of coagulation of the anatase-type titanium oxide and the rutile-type titanium oxide. In other words, when a latent-image developing toner is formed with the degree of coagulation of the anatase-type titanium oxide and the rutile-type titanium oxide at 10%, the resultant toner has a low initial charge-to-mass ratio of 20 $\mu$C/g or below and a low image density of below 1.3. These values are even lower after an endurance test has been performed, with the charge-to-mass ratio falling by 5 $\mu$C/g or more to 15 $\mu$C/g or below and the image density falling by 0.1 or more to below 1.2.

On the other hand, when the degree of coagulation of both anatase-type titanium oxide and rutile-type titanium oxide is below 10%, the charge-to-mass ratio of the resultant latent-image developing toner is a high value of around 25 $\mu$C/g, both initially and after the endurance test has been performed. From this it can be understood that the charging characteristics hardly change even when an endurance test is performed.

In the same way, the image density of the resultant latent-image developing toner has a high value of around 1.3 to 1.4 both initially and after the endurance test has been performed. From this it can be understood that the image density hardly changes even when an endurance test is performed.

From the above results it can be said that setting the degree of coagulation of both the anatase-type titanium oxide and rutile-type titanium oxide used in a toner at below 10%, the toner can be formed with superior charging characteristics and image density both initially and after an endurance test has been performed, making this setting highly effective.

It should be noted that the degree of coagulation of the anatase-type titanium oxide and the rutile-type titanium oxide (which is described later in this specification) can be defined using values that are obtained by the following measuring method (a filtering method). In more detail, 1.0 g of titanium oxide is placed in a beaker with 200 ml of ethanol and is agitated using an ultrasonic disperser so as to sufficiently disperse the titanium oxide, thereby producing a titanium oxide dispersed solution. After this, 500-mesh filter paper is placed in a filter holder and the titanium oxide dispersed solution is subjected to suction filtration. The filter paper is then taken from the filter holder and dried. Next, the weight of the titanium oxide remaining on the filter paper is measured, with the resultant value being x (g). Accordingly, the degree of coagulation y (%) of the anatase-type titanium oxide and the rutile-type titanium oxide (described later) can be found according to the following equation.

$$y(\%)=x(g)/1.0(g)\times 100$$

In order to control the of coagulation of the anatase-type titanium oxide and the rutile-type titanium oxide (described later), it is preferable to add a dispersant such as an amphoteric surface active agent, a resin varnish, an anionic dispersant, or a nonionic surface active agent.

Amphoteric surface active agents are defined as compounds that are composed of an anionic part and a cationic part. As examples, the anionic part of an amphoteric surface active agent may be a carboxylate such as an alkaline metal salt of a higher fatty acid, a sulfate such as a higher alcohol or higher alkyl ether, a sulfonate such as alkyl benzene and alkyl naphthalene, and a phosphate ester such as a higher alcohol. On the other hand, an amine salt of higher alkyl, and a quaternary ammonium salt of higher alkyl are examples of the cationic part of an amphoteric surface active agent. Examples of amphoteric surface active agents that may be used include: soyabean lecithin; sodium lauryl aminopropionate; stearyl dimethyl betaine; lauryl dihydroxyethyl betaine; coconut oil fatty acid amide propyl dimethyl betaine; 2-alkyl-N-carboxymethyl-N-hydroxyethyl imidazolinium betaine; 2-alkyl-N-carboxyethyl-N-hydroxyethyl imidazolinium betaine; and 2-alkyl-N-sodium carboxymethyl-N-carboxymethyl oxyethyl imidazolinium betaine.

(2) Rutile-Type Titanium Oxide (i) Average Particle Diameter

It is preferable for the average particle diameter of rutile-type titanium oxide to be in a range such that the average particle diameter is at least 200 nm but is below 500 nm. The reason for this is that when the average particle diameter of rutile-type titanium oxide is 500 nm or above, there are cases where it is difficult to make the charging characteristics even or to mix and disperse the rutile-type titanium oxide among the toner particles. On the other hand, when the average particle diameter of the rutile-type titanium oxide is below 200 nm, there are cases where it is difficult to make the charging characteristics even and where the rutile-type titanium oxide is susceptible to coagulation. Consequently, it is more preferable for the average particle diameter of the rutile-type titanium oxide to fall in a range of 200 to 300 nm.

(ii) Volume Resistivity

When the toner is used with an OPC photosensitive roll it is preferable for the volume resistivity of the rutile-type titanium oxide to fall in a range of $1\times10^4$ to $1\times10^{15}$ Ohm-cm. On the other hand, when the toner is used with an a-Si photosensitive roll, it is preferable for the volume resistivity of the rutile-type titanium oxide to fall in a range of $1\times10^1$ to $1\times10^7$ Ohm-cm. The reason for this is that when the toner is used with an OPC photosensitive roll and the volume resistivity for rutile-type titanium oxide is outside the range given above, there are cases where there is deterioration in the charging characteristics of the toner which can cause a fall in the image density, resultant in white areas being left in the formed image. When the toner is used with an a-Si photosensitive roll and the volume resistivity for rutile-type titanium oxide is above $1\times10^7$ Ohm-cm, there are cases where the charge-to-mass ratio is too great, resultant in charging ability with use/time_that can cause a contrary drop in the image density and in durability. When an a-Si photosensitive roll is used and there is an excessive increase in charge, discharge breakdown occurs, and there are cases where black spots appear in the image.

Accordingly, when an OPC photosensitive roll is used, it is more preferable for the volume resistivity of the rutile-type titanium oxide to fall in a range of $1\times10^5$ to $1\times10^{14}$ Ohm-cm, with it being even more preferable for the volume resistivity to fall in a range of $1\times10^6$ to $1\times10^{13}$ Ohm-cm. When an a-Si photosensitive roll is used, it is more preferable for the volume resistivity of the rutile-type titanium oxide to fall in a range of $1\times10^2$ to $1\times10^6$ Ohm-cm, with it being even more preferable for the volume resistivity to fall in a range of $1\times10^3$ to $1\times10^5$ Ohm-cm.

(iii) Surface Treatment

It is preferable for the rutile-type titanium oxide to be subjected to a surface treatment using a surfactant composed of one or both of a titanate coupling agent and a silane coupling agent. In more detail, rutile-type titanium oxide is usually hydrophilic, so that it is preferable for its surfaces to be given a hydrophobic treatment using a silane coupling agent or the like.

It should be noted that the same types of titanate coupling agent may be used as with anatase-type titanium oxide. As examples, a favorable silane coupling agent may be any one or combination of two or more of the following: propyl trimethoxysilane; propyl dimethoxymethyl silane; propyl triethoxysilane; butyl trimethoxysilane; butyl dimethoxymethyl silane; butyl triethoxysilane; vinyl trimethoxysilane; vinyl dimethoxymethyl silane; vinyl triethoxysilane; vinyl diethoxy methylsilane; hexyl trimethoxysilane; hexyl dimethoxymethyl silane; hexyl triethoxysilane; hexyl diethoxy methylsilane; phenyl trimethoxysilane; phenyl dimethoxymethyl silane; phenyl triethoxysilane; phenyl diethoxy methylsilane; y-gylcidoxy propyl trimethoxy silane; y-gylcidoxy propyl dimethoxymethyl silane; y-gylcidoxy propyl triethoxy silane; and y-gylcidoxy propyl diethoxymethyl silane.

(iv) Degree of Coagulation

It is preferable to set the degree of coagulation of the rutile-type titanium oxide at below 10%. The reason for this is that as with anatase-type titanium oxide, if the degree of coagulation of the rutile-type titanium oxide is 10% or above, effective electrostatic adhesion to the toner particles is not achieved, so that the rutile-type titanium oxide is susceptible to coming off the toner particles. Also, if the degree of coagulation of the rutile-type titanium oxide is 10% or above, it becomes difficult for the effects of the rutile-type titanium oxide to be realized, resultant in problems such as deterioration in the image characteristics, a drop in the durability, and in the occurrence of blurring phenomena. Also, when the degree of coagulation of the rutile-type titanium oxide is 10% or above, the charge distribution becomes uneven, resultant in problems such as an increased incidence of background printing. Consequently, it is preferable for the degree of coagulation of the rutile-type titanium oxide to be 5% or below, with a degree of coagulation that is 1% or below being even more preferable.

It should be noted that it is preferable for pulverizing to be performed using a pulverizer so as to control the degree of coagulation of the rutile-type titanium oxide. As examples, a counterjet mill formed by Hosokawa Micron Group or a "Super Sonic Jet Mill: IDS" formed by Nippon Pneumatic Manufacturing Co, Ltd can be used.

(3) Added Proportions

When the added amount of anatase-type titanium oxide is set at Aw and the added amount of rutile-type titanium oxide is set at Rw, the ratio by weight expressed by Aw/Rw should be in a range of 10/90 to 90/10. The reason for this is that when the added amount of anatase-type titanium oxide is below 10% (which is to say, when the proportion of rutile-type titanium oxide is 90% or above), there is insufficient abrasion, so that there can be image defects such as blurring phenomena at high temperatures and high humidity.

Conversely, when the added amount of anatase-type titanium oxide is 90% or above (which is to say, when the proportion of rutile-type titanium oxide is below 10%), the charge-to-mass ratio of the toner exceeds the appropriate level, resultant in an charging ability with time/use and in the charge distribution becoming broad. This can lead to a reduction in image density and in poor durability.

Consequently, it is preferred that the ratio of the added proportions of anatase-type titanium oxide and rutile-type titanium oxide is such that the ratio by weight expressed by Aw/Rw falls in a range of 20/80 to 80/20, with a ratio in a range of 30/70 to 70/30 being even more preferable.

The following describes, with reference to FIGS. 2 to 5, the relationship between the added proportions of anatase-type titanium oxide and rutile-type titanium oxide and the charging characteristics, image density, incidence of background printing and incidence of blurring phenomena.

Figure 2:
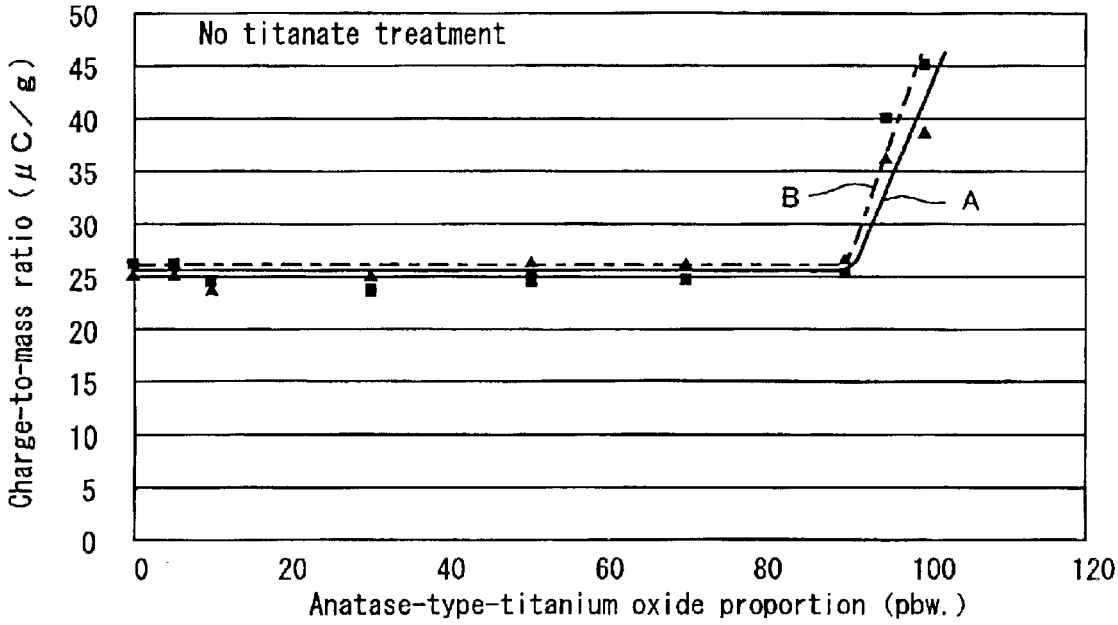
FIG. 2 shows, for an electrostatic latent image developing toner, the relationship between (i) the added proportions of anatase-type titanium oxide and rutile-type titanium oxide and (ii) the charging characteristics.

The horizontal axis in FIG. 2 shows the added proportions (by weight) of anatase-type titanium oxide/rutile-type titanium oxide, while the vertical axis shows the charge-to-mass ratio ($\mu$C/g). The initial charge-to-mass ratio ($\mu$C/g) is shown by the solid line (line A), while the charge-to-mass ratio ($\mu$C/g) after an endurance test is shown by the dot-dash line (line B). As should be clear from FIG. 2, when the ratio of the added proportions (by weight) of anatase-type titanium oxide and rutile-type titanium oxide is in a range of 10/90 to 90/10, stable values are obtained both for the initial charge-to-mass ratio and the charge-to-mass ratio after an endurance test. However, when the ratio of the added proportions (by weight) is in a range of 95/5 to 100/0, there is a large increase in the charge-to-mass ratio, and an increase in charge occurs after an endurance test, causing a large change in the charge-to-mass ratio. To stabilize the initial charge-to-mass ratio and charge-to-mass ratio after an endurance test, it is effective to set the ratio by weight expressed by Aw/Rw at 90/10 or below.

Figure 3:
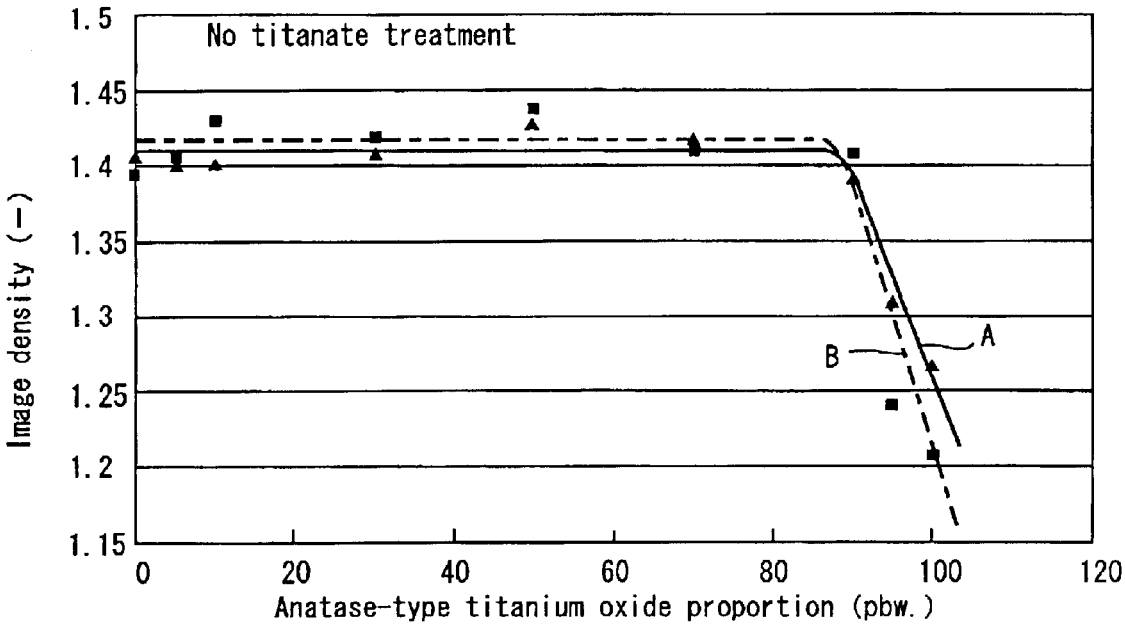
FIG. 3 shows, for an electrostatic latent image developing toner, the relationship between (i) the added proportions of anatase-type titanium oxide and rutile-type titanium oxide and (ii) image density.

The horizontal axis in FIG. 3 shows the ratio of the added proportions (by weight) of anatase-type titanium oxide and rutile-type titanium oxide, while the vertical axis shows the image density (–). The initial image density (–) is shown by the solid line (line A), while the image density (–) after an endurance test is shown by the dot-dash line (line B).

As should be clear from FIG. 3, when the ratio of the added proportions (by weight) of anatase-type titanium oxide and rutile-type titanium oxide is in a range of 10/90 to 90/10, stable values of around 1.40 are obtained both for the initial image density and the image density after an endurance test. However, when the ratio of the added proportions (by weight) is in a range of 95/5 to 100/0, the initial image density and image density after an endurance test fall to 1.2 to 1.3. To stabilize the initial charge-to-mass ratio and charge-to-mass ratio after an endurance test, the ratio by weight expressed by Aw/Rw should be 90/10 or below.

Figure 4:
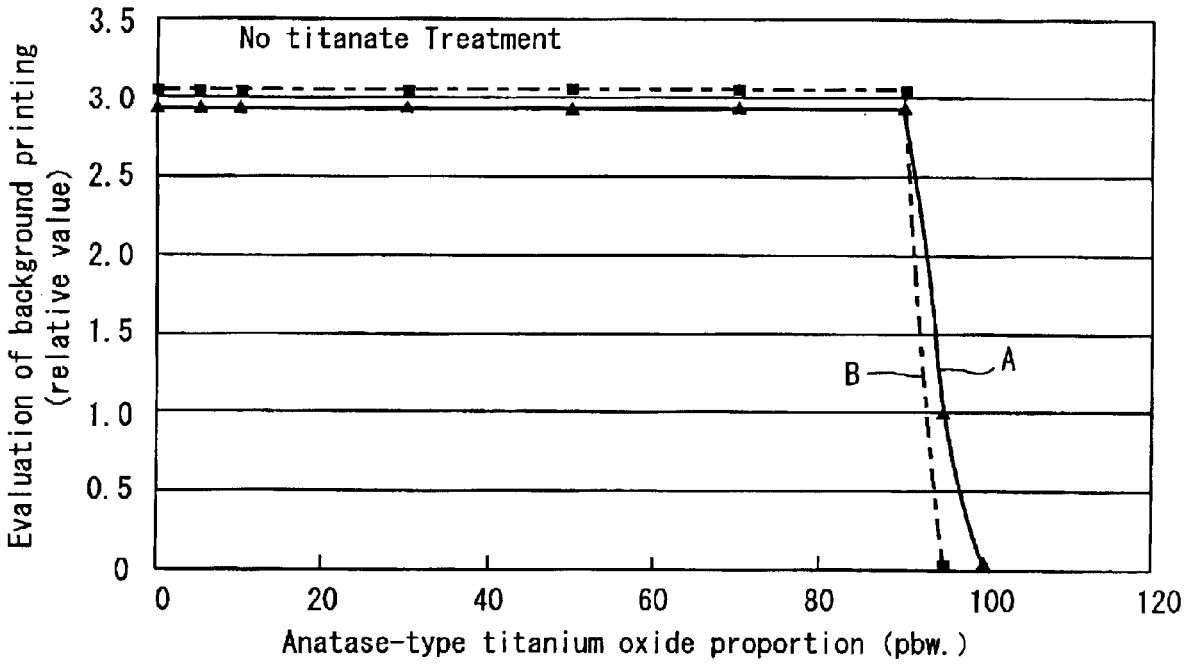
FIG. 4 shows, for an electrostatic latent image developing toner, the relationship between (i) the added proportions of anatase-type titanium oxide and rutile-type titanium oxide and (ii) background printing.

The horizontal axis in FIG. 4 shows the ratio of the added proportions (by weight) of anatase-type titanium oxide and rutile-type titanium oxide, while the vertical axis shows an evaluation mark (relative value) of the incidence of background printing. The initial evaluation mark (relative value) is shown by the solid line (line A), while the evaluation mark (relative value) after an endurance test is shown by the dot-dash line (line B). It should be noted that a "Good" evaluation of the incidence of background printing is considered to be worth three marks, a "Fair" evaluation worth one mark, and a "Bad" evaluation worth zero marks.

As should be clear from FIG. 4, when the ratio of the added proportions (by weight) of anatase-type titanium oxide and rutile-type titanium oxide is in a range of 10/90 to 90/10, stable values of 3 marks are obtained both for the initial evaluation and the evaluation after an endurance test. However, when the ratio of the added proportions (by weight) is in a range of 95/5 to 100/0, the initial evaluation and evaluation after an endurance test fall to a range of 0 to 1 evaluation marks. To obtain superior results for the incidence of background printing both initially and after an endurance test, the ratio by weight expressed by Aw/Rw should be 90/10 or below.

Figure 5:
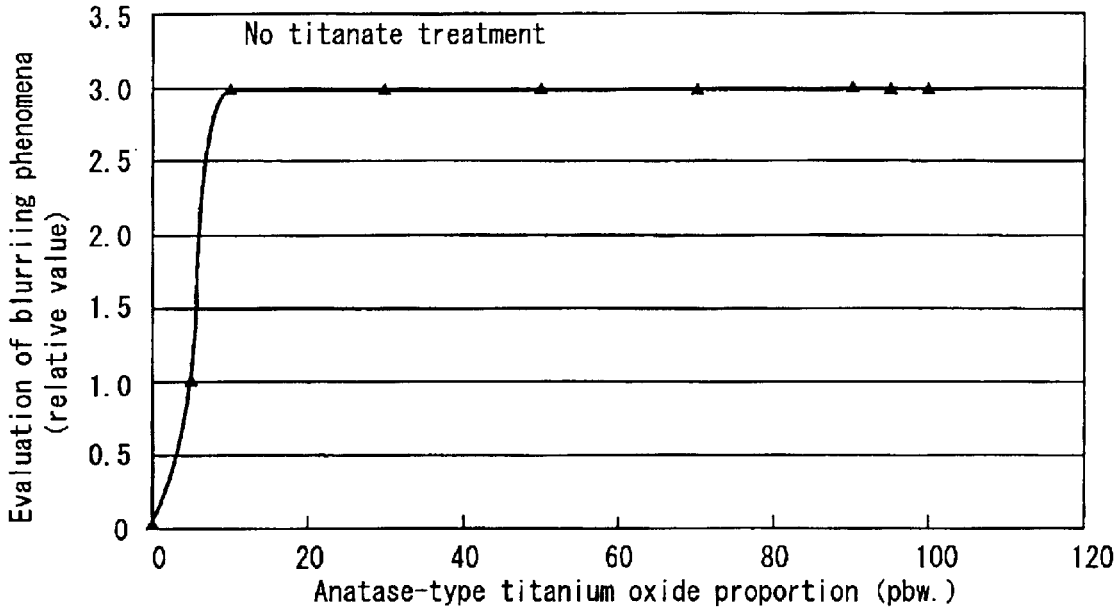
FIG. 5 shows, for an electrostatic latent image developing toner, the relationship between (i) the added proportions of anatase-type titanium oxide and rutile-type titanium oxide and (ii) blurring phenomena.
Figure 6:
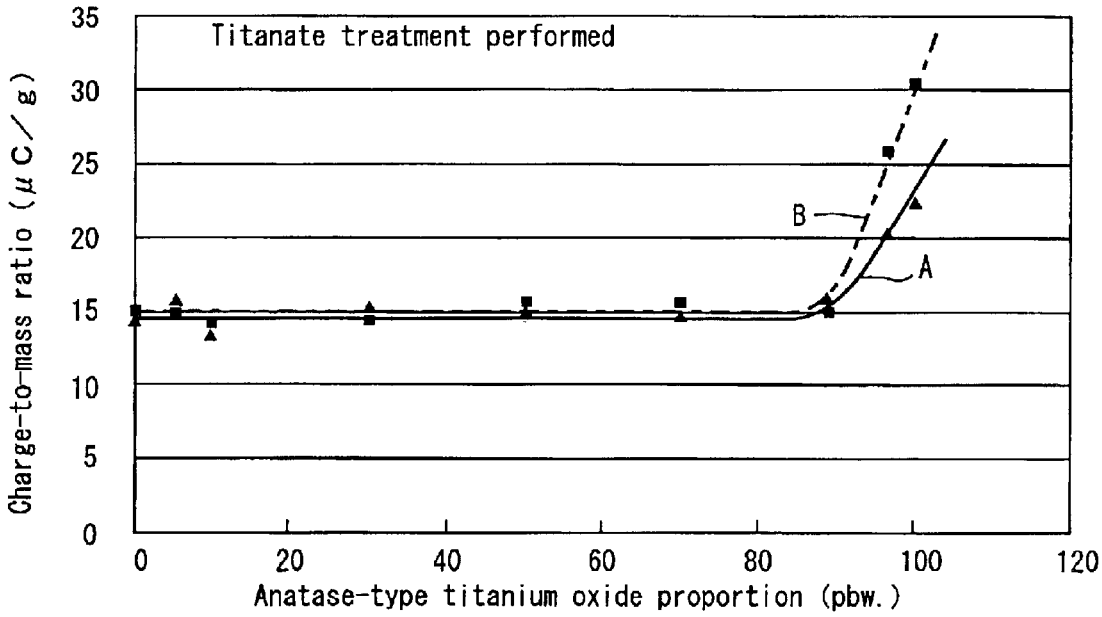
FIG. 6 shows, for an electrostatic latent image developing toner, the relationship between (i) the added proportions of anatase-type titanium oxide and rutile-type titanium oxide, which have been surface treated with a titanate coupling agent, and (ii) the charging characteristics.
Figure 7:
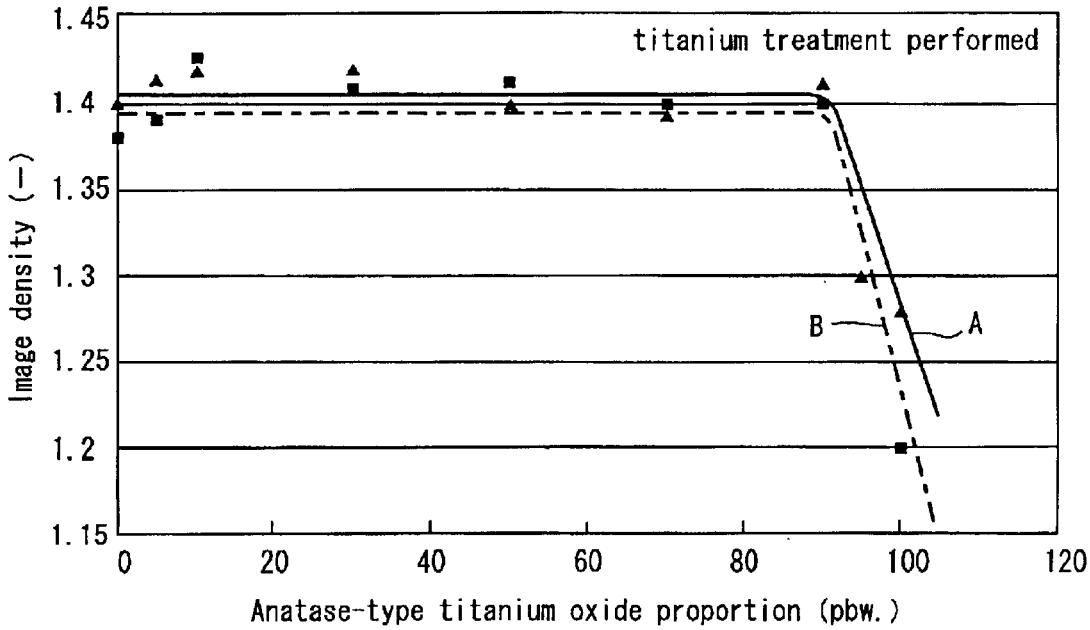
FIG. 7 shows, for an electrostatic latent image developing toner, the relationship between (i) the added proportions of anatase-type titanium oxide and rutile-type titanium oxide, which have been surface treated with a titanate coupling agent, and (ii) image density.
Figure 8:
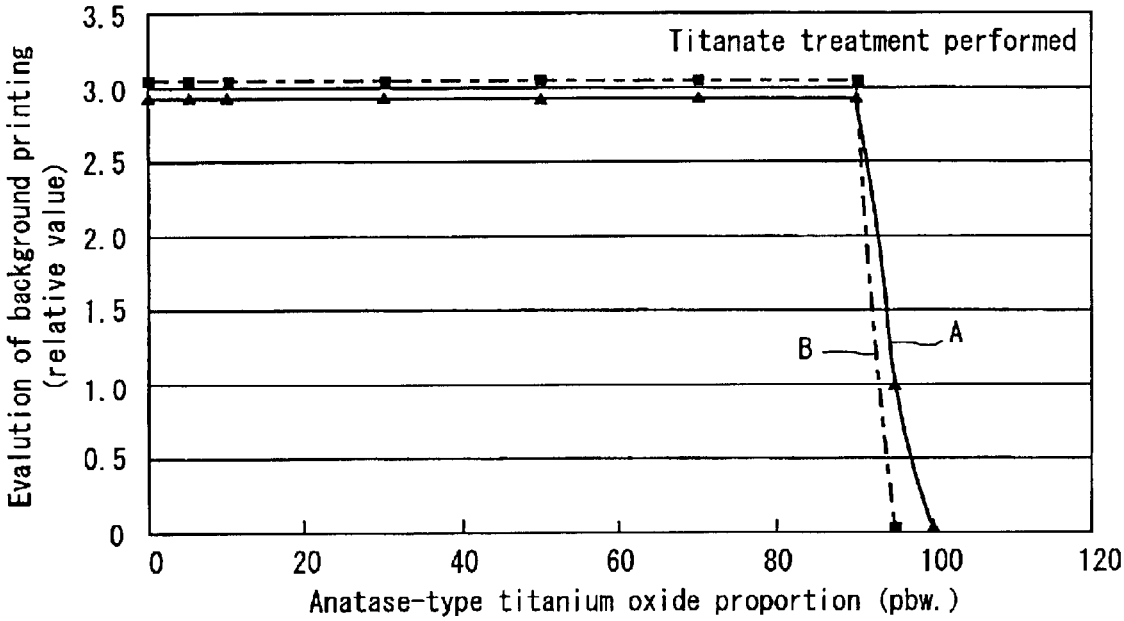
FIG. 8 shows, for an electrostatic latent image developing toner, the relationship between (i) the added proportions of anatase-type titanium oxide and rutile-type titanium oxide, which have been surface treated with a titanate coupling agent, and (ii) background printing.
Figure 9:
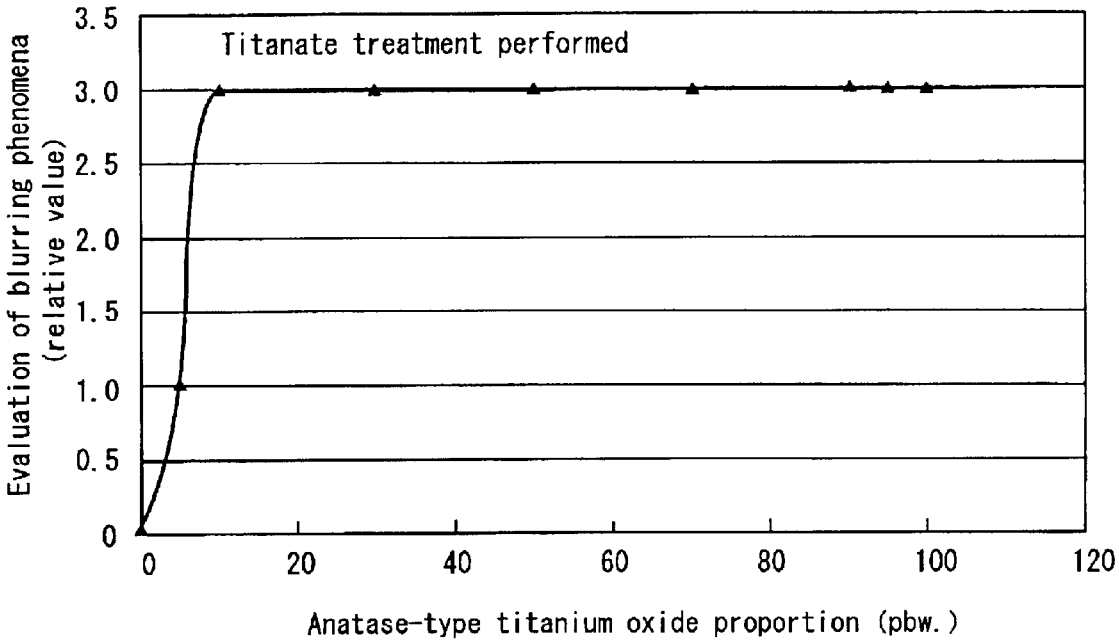
FIG. 9 shows, for an electrostatic latent image developing toner, the relationship between (i) the added proportions of anatase-type titanium oxide and rutile-type titanium oxide, which have been surface treated with a titanate coupling agent, and (ii) blurring phenomena.
Figure 10:
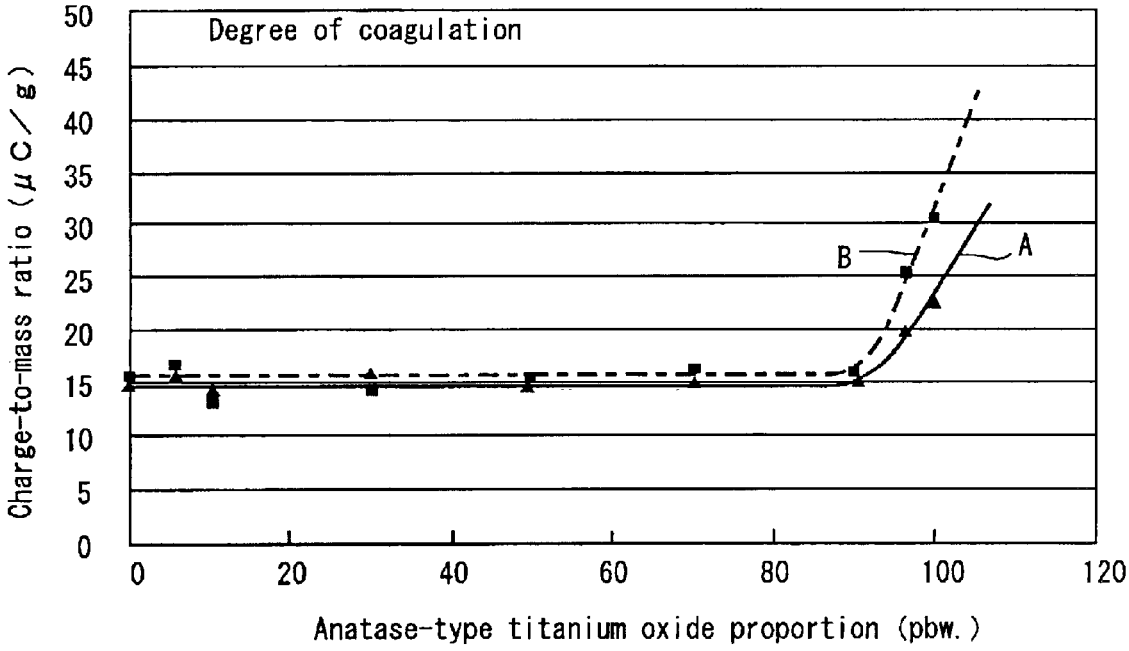
FIG. 10 shows, for an electrostatic latent image developing toner, the relationship between (i) the added proportions of anatase-type titanium oxide and rutile-type titanium oxide, whose degree of coagulation has been changed, and (ii) charging characteristics.
Figure 11:
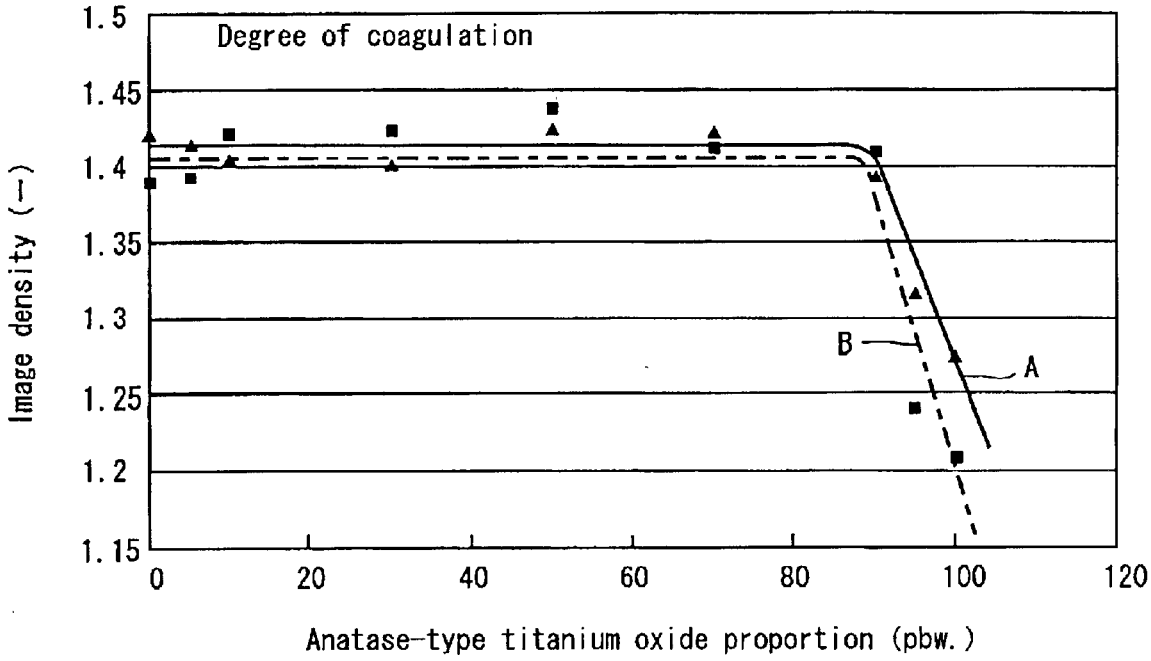
FIG. 11 shows, for an electrostatic latent image developing toner, the relationship between (i) the added proportions of anatase-type titanium oxide and rutile-type titanium oxide, whose degree of coagulation has been changed, and (ii) image density.
Figure 12:
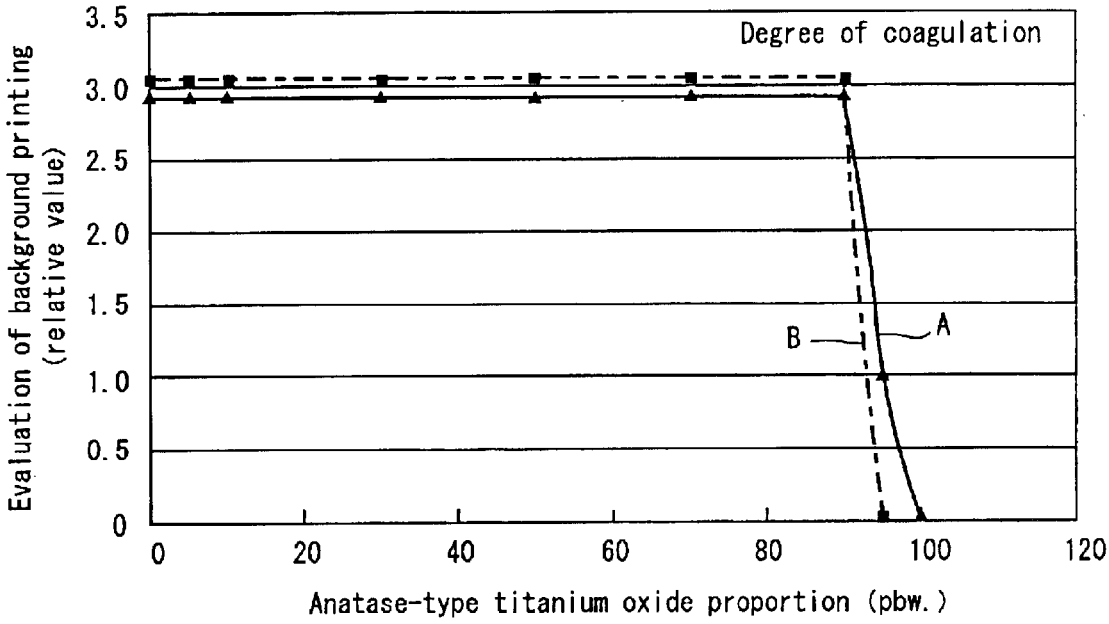
FIG. 12 shows, for an electrostatic latent image developing toner, the relationship between (i) the added proportions of anatase-type titanium oxide and rutile-type titanium oxide, whose degree of coagulation has been changed, and (ii) background printing.
Figure 13:
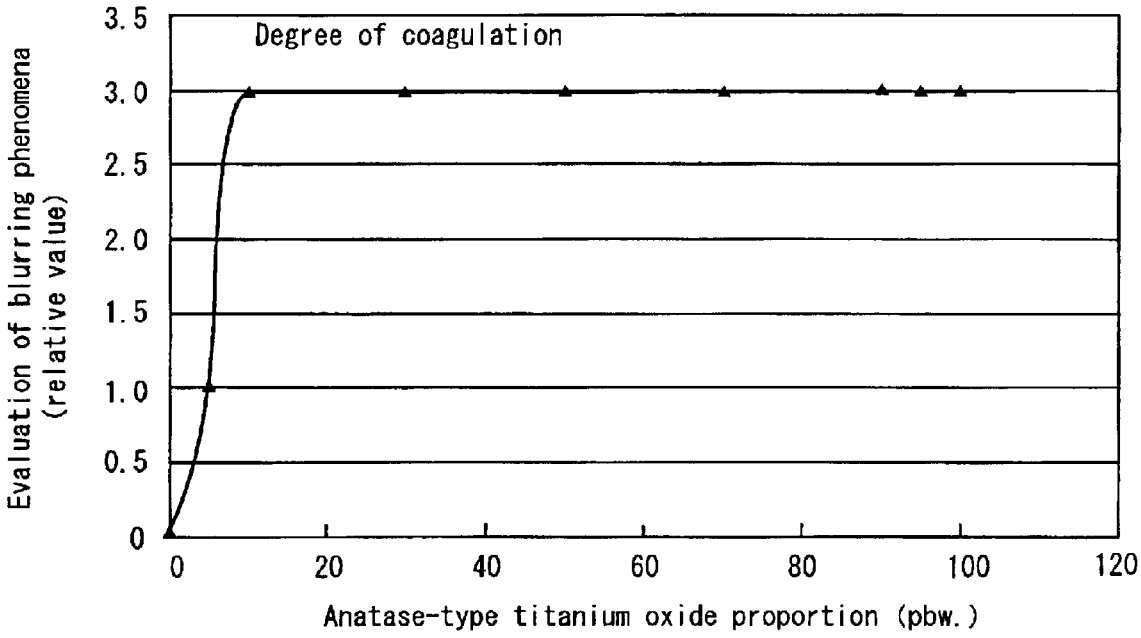
FIG. 13 shows, for an electrostatic latent image developing toner, the relationship between (i) the added proportions of anatase-type titanium oxide and rutile-type titanium oxide, whose degree of coagulation has been changed, and (ii) blurring phenomena.

The horizontal axis in FIG. 5 shows the ratio of the added proportions (by weight) of anatase-type titanium oxide and rutile-type titanium oxide, while the vertical axis shows an evaluation mark (relative value) of the incidence of blurring phenomena. It should be noted that a "Good" evaluation of the incidence of blurring phenomena is considered to be worth three marks, a "Fair" evaluation worth one mark, and a "Bad" evaluation worth zero marks.

As should be clear from FIG. 5, when the ratio of the added proportions (by weight) of anatase-type titanium oxide and rutile-type titanium oxide is in a range of 10/90 to 90/10, stable values of 3 marks are obtained both for the initial evaluation and the evaluation after an endurance test. However, when the ratio of the added proportions (by weight) is in a range of 5/95 to 0/100, the initial evaluation and evaluation after an endurance test fall to a range of 0 to 1 evaluation marks. To obtain superior results for the incidence of blurring phenomena both initially and after an endurance test, the ratio by weight expressed by Aw/Rw should be 10/90 or above.

It should be noted that FIGS. 2 to 5 show the results for a latent image-developing toner in which the anatase-type titanium oxide/rutile-type titanium oxide are not treated with titanate. While the values in the results for a latent image-developing toner in which the anatase-type titanium oxide and rutile-type titanium oxide have been treated with a titanate coupling agent are different, the same tendencies are observed, as shown in FIGS. 6 to 9 in which the solid lines marked as line A show the initial values and the dot-dash lines marked as line B show the values after an endurance test.

Also, as shown in FIGS. 10 to 13, in which the solid lines marked as line A show the initial values and the dot-dash lines marked as line B show the values after an endurance test, the results shown in FIGS. 2 to 5 were favorably reproduced for an electrostatic latent image developing toner.

Furthermore, in FIGS. 22 to 31, in which the solid lines marked as line A show the initial values and the dot-dash lines marked as line B show the values after an endurance test, it was confirmed that the same tendencies are observed for a MICR toner as for an electrostatic latent image-developing toner.

(4) Added Amount

It is preferable for the total added amount of anatase-type titanium oxide and rutile-type titanium oxide to fall in a range of 0.5 to 5% by weight added to the total weight of the toner particles. The reason for this is that when the total added amount is below 0.5% by weight, there are cases where the abrasive effect on the photosensitive roll is insufficient and where blurring phenomena occurs at high temperatures and high humidity, resultant in image defects. On the other hand, when the total added amount is above 5%, there are cases where there is pronounced deterioration in the fluidity of the toner, resultant in decreases in image density and durability. Consequently, it is more preferable for the total added amount of anatase-type titanium oxide and rutile-type titanium oxide to fall in a range of 0.6 to 4.5% by weight, with it being even more preferable for the total added amount to fall in a range of 0.7 to 4.3% by weight.

Figure 20:
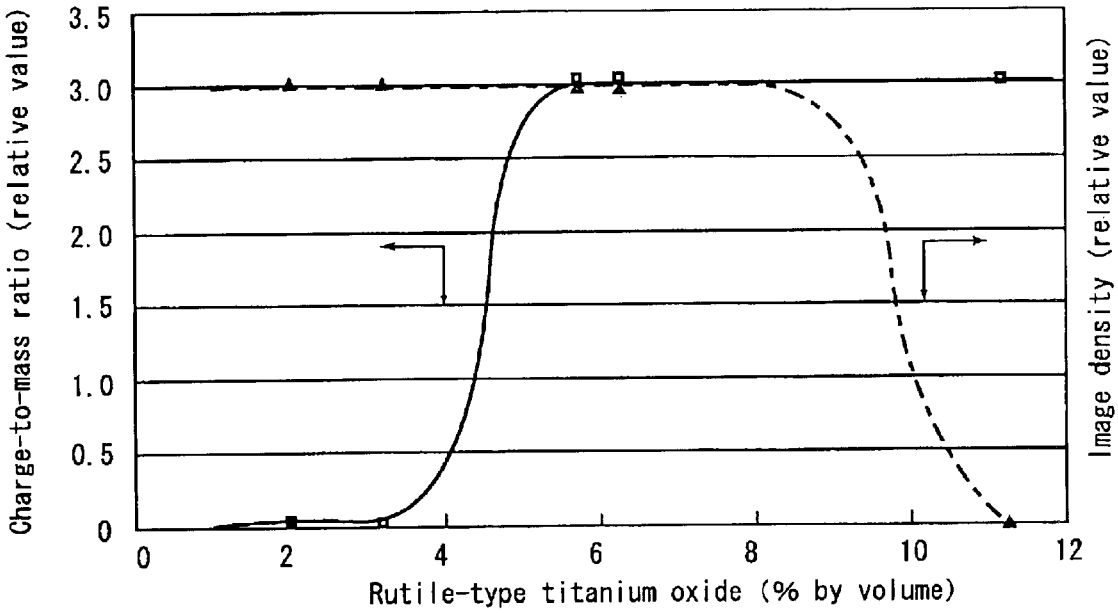
FIG. 20 shows one example of the relationships between the proportion by volume of rutile-type titanium oxide in an electrostatic latent image developing toner and (a) susceptibility to the toner marking in the defined area and (b) image density stability.
Figure 21:
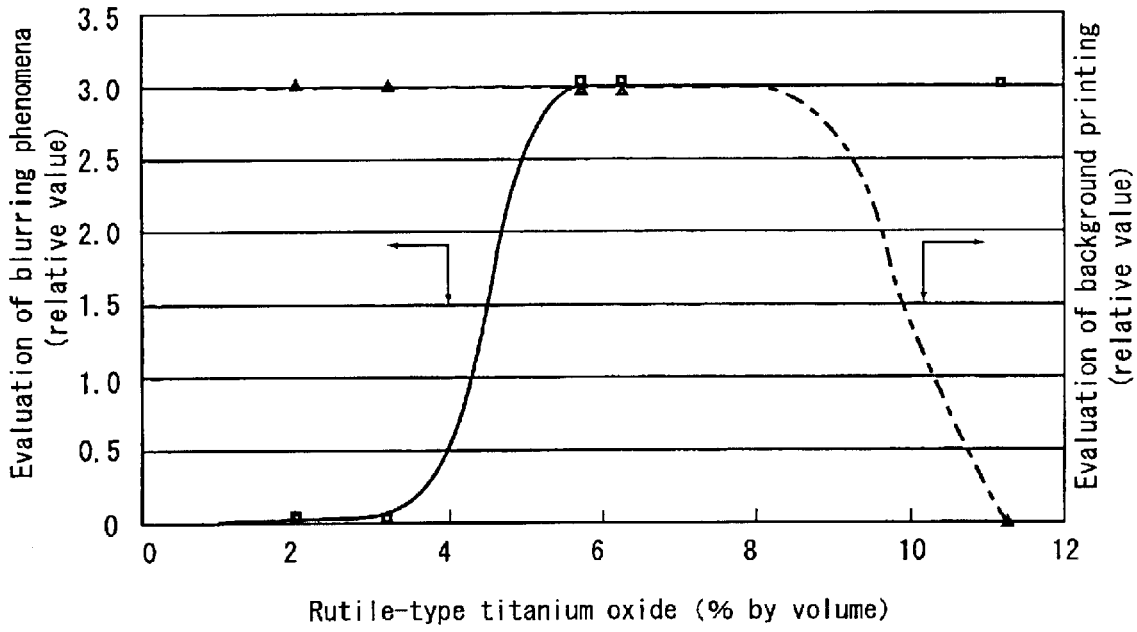
FIG. 21 shows one example of the relationships between the proportion by volume of rutile-type titanium oxide in an electrostatic latent image developing toner and (a) blurring phenomena and (b) background printing.
Figure 22:
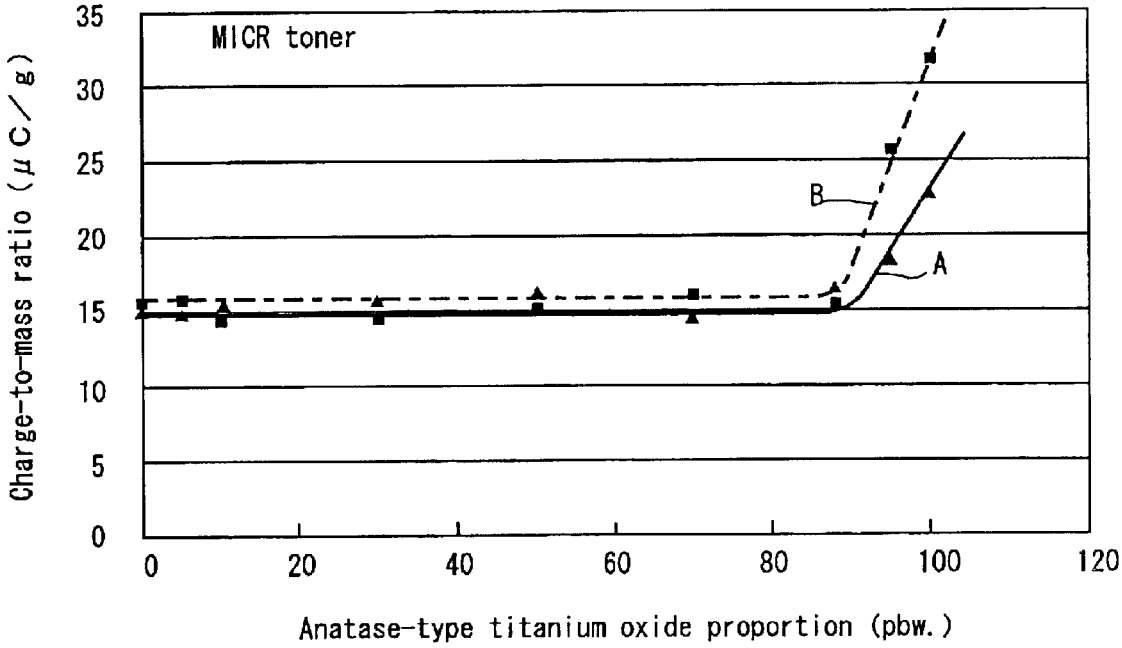
FIG. 22 shows, for a MICR toner, the relationship between (i) the added proportions of anatase-type titanium oxide and rutile-type titanium oxide and (ii) the charging characteristics.
Figure 23:
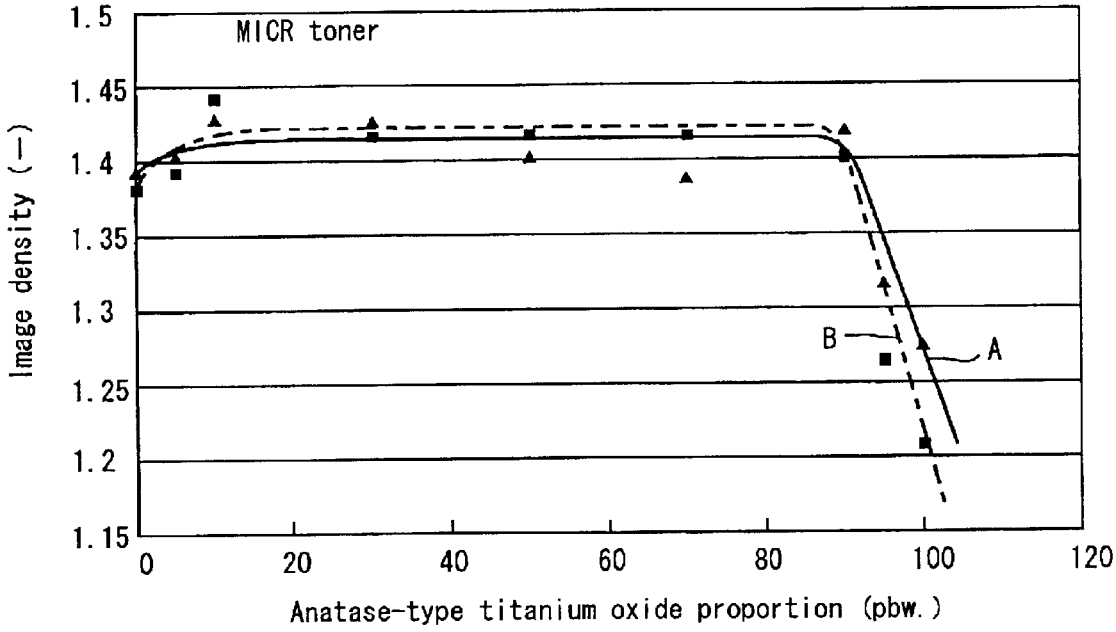
FIG. 23 shows, for a MICR toner, the relationship between (i) the added proportions of anatase-type titanium oxide and rutile-type titanium oxide and (ii) image density.
Figure 24:
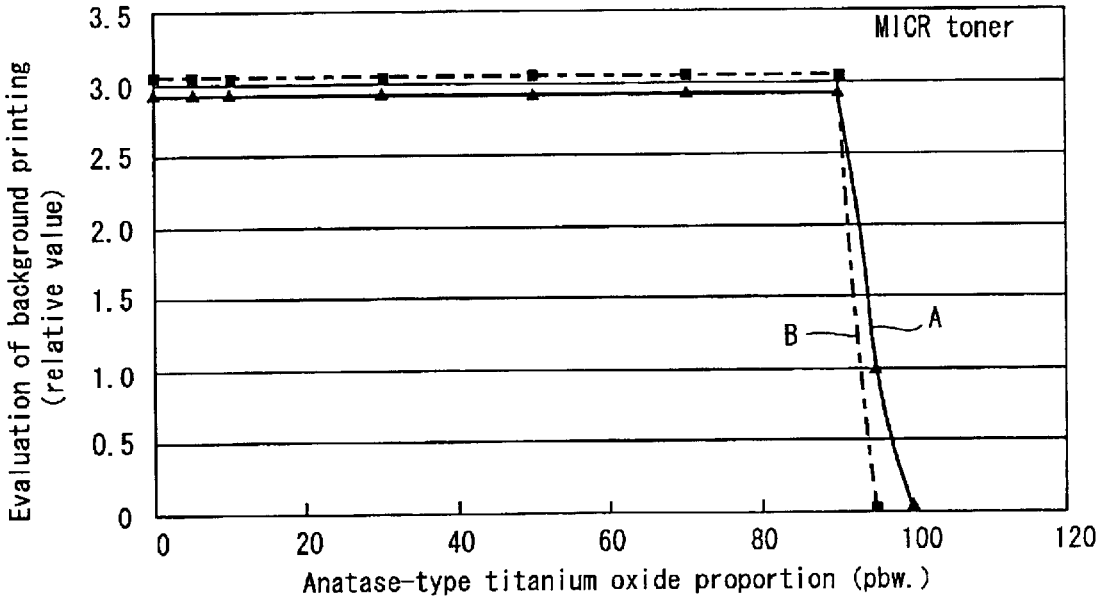
FIG. 24 shows, for a MICR toner, the relationship between (i) the added proportions of anatase-type titanium oxide and rutile-type titanium oxide and (ii) background printing.
Figure 25:
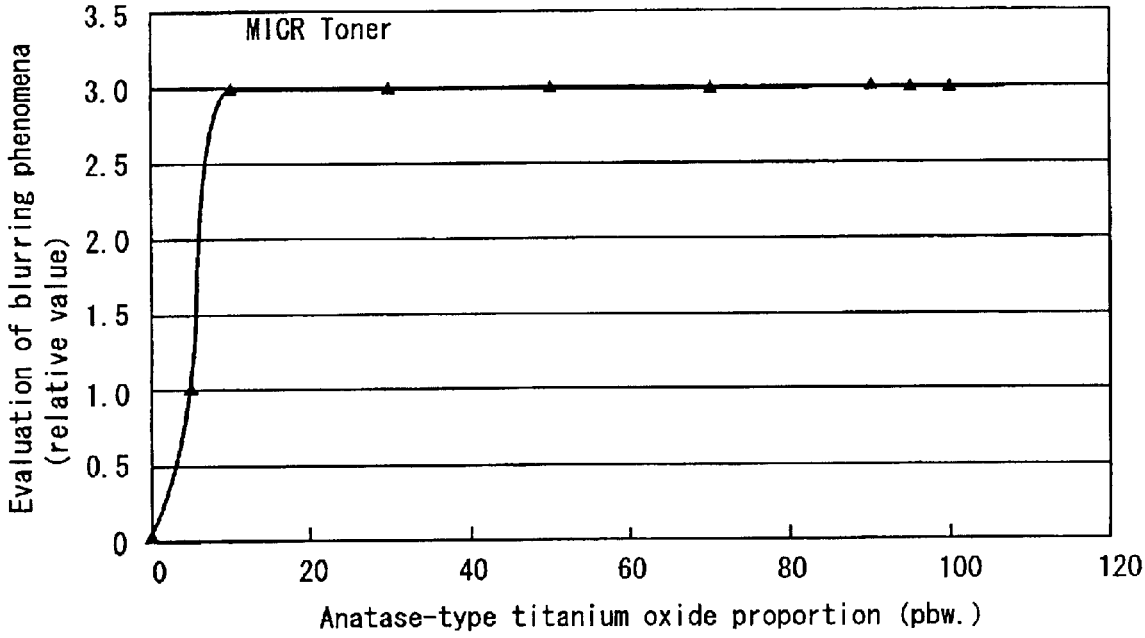
FIG. 25 shows, for a MICR toner, the relationship between (i) the added proportions of anatase-type titanium oxide and rutile-type titanium oxide and (ii) blurring phenomena.
Figure 26:
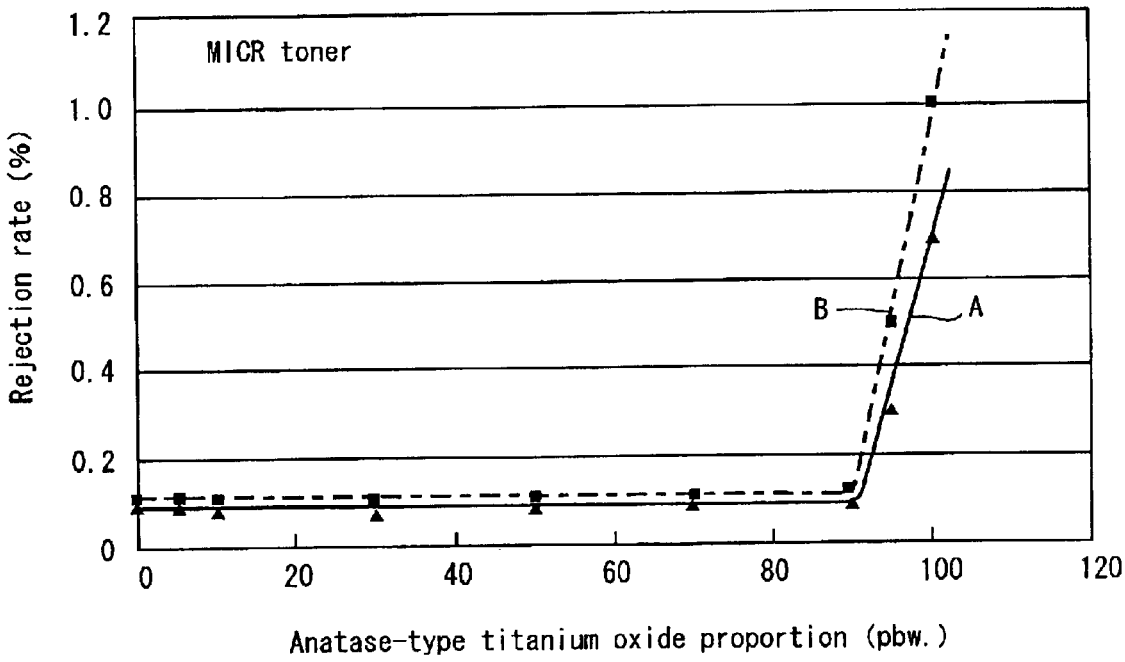
FIG. 26 shows, for a MICR toner, the relationship between (i) the added proportions of anatase-type titanium oxide and rutile-type titanium oxide and (ii) the rejection rate.
Figure 27:
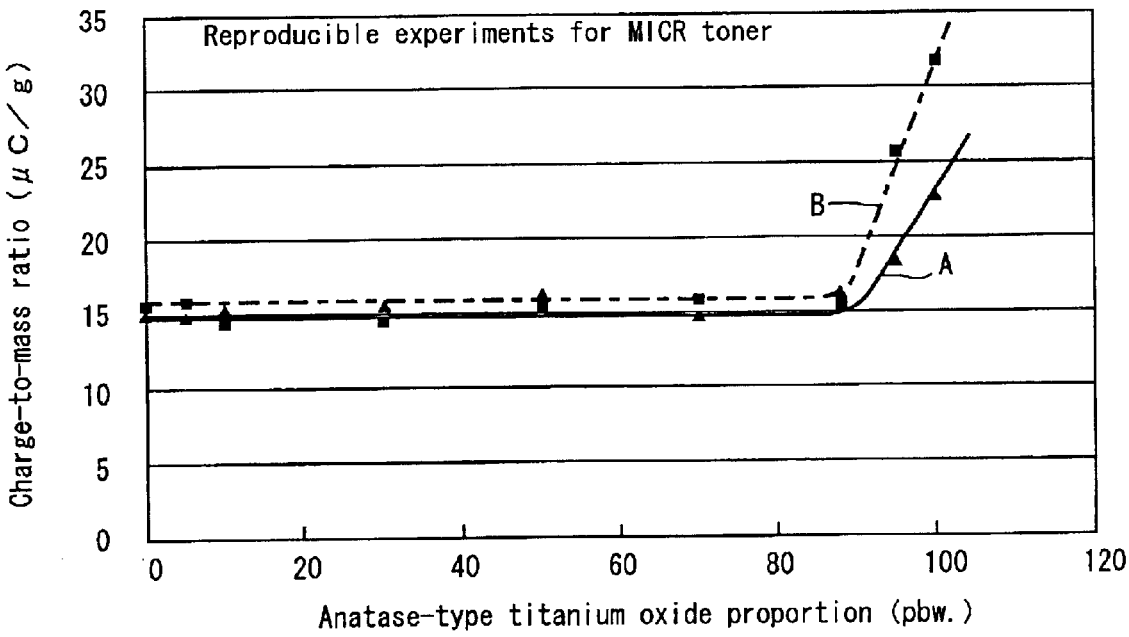
FIG. 27 shows, for a MICR toner, the relationship (in reproducibility experiments) between (i) the added proportions of anatase-type titanium oxide and rutile-type titanium oxide and (ii) the charging characteristics.
Figure 28:
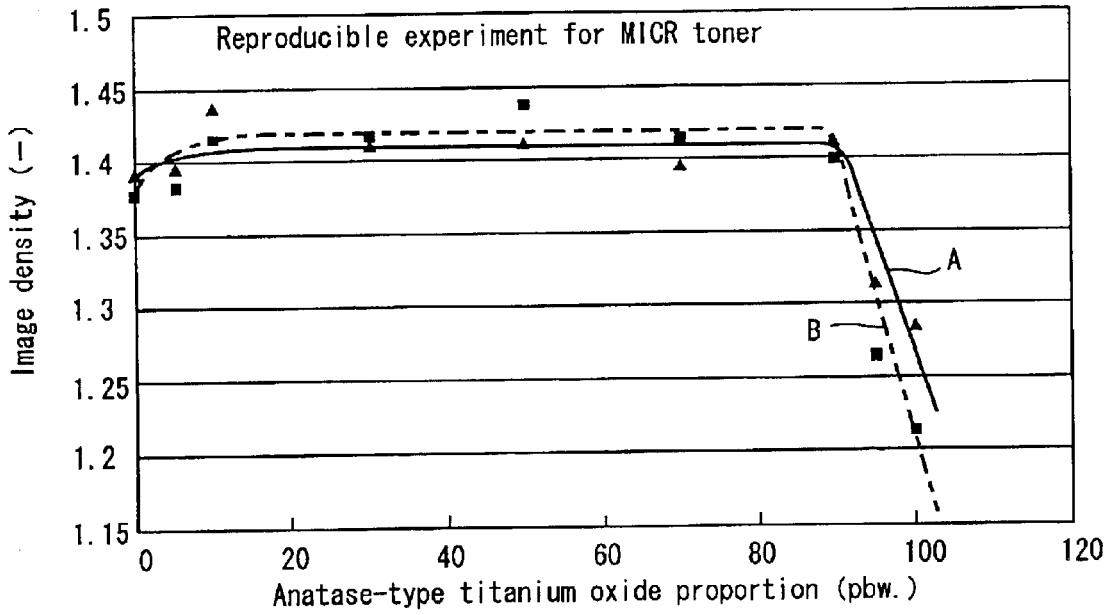
FIG. 28 shows, for a MICR toner, the relationship (in reproducibility experiments) between (i) the added proportions of anatase-type titanium oxide and rutile-type titanium oxide and (ii) image density.
Figure 29:
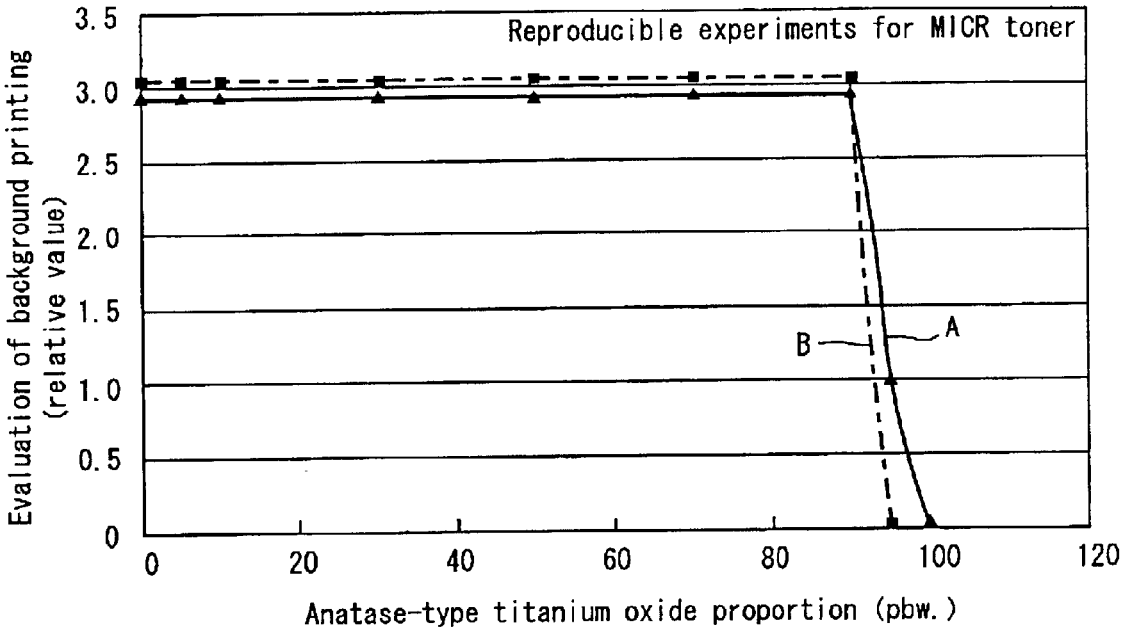
FIG. 29 shows, for a MICR toner, the relationship (in reproducibility experiments) between (i) the added proportions of anatase-type titanium oxide and rutile-type titanium oxide and (ii) background printing.
Figure 30:
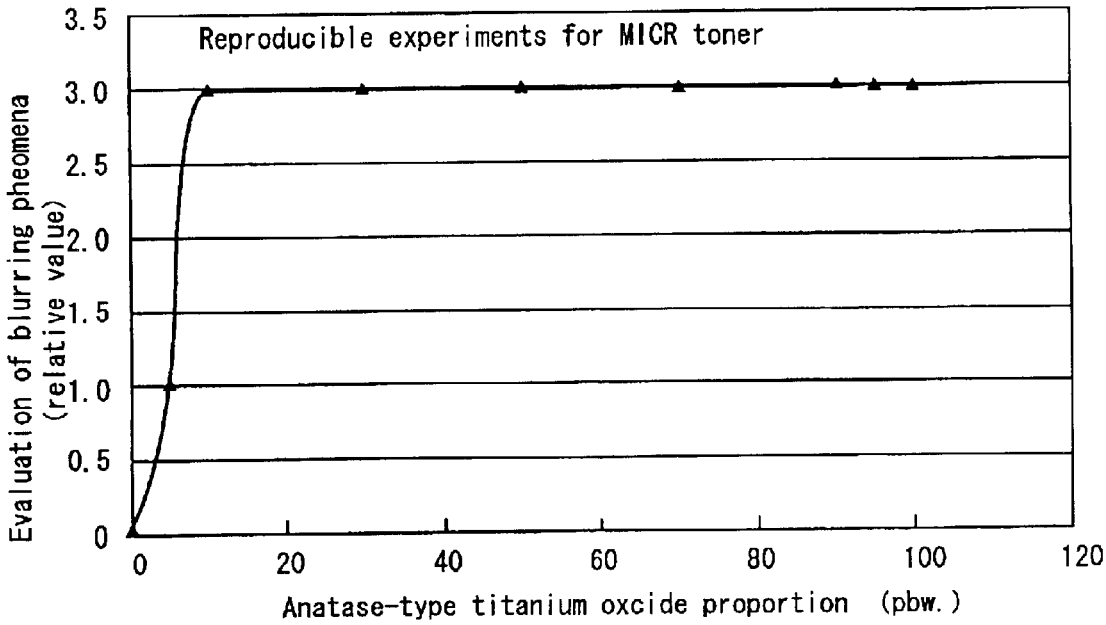
FIG. 30 shows, for a MICR toner, the relationship (in reproducibility experiments) between (i) the added proportions of anatase-type titanium oxide and rutile-type titanium oxide and (ii) blurring phenomena.
Figure 31:
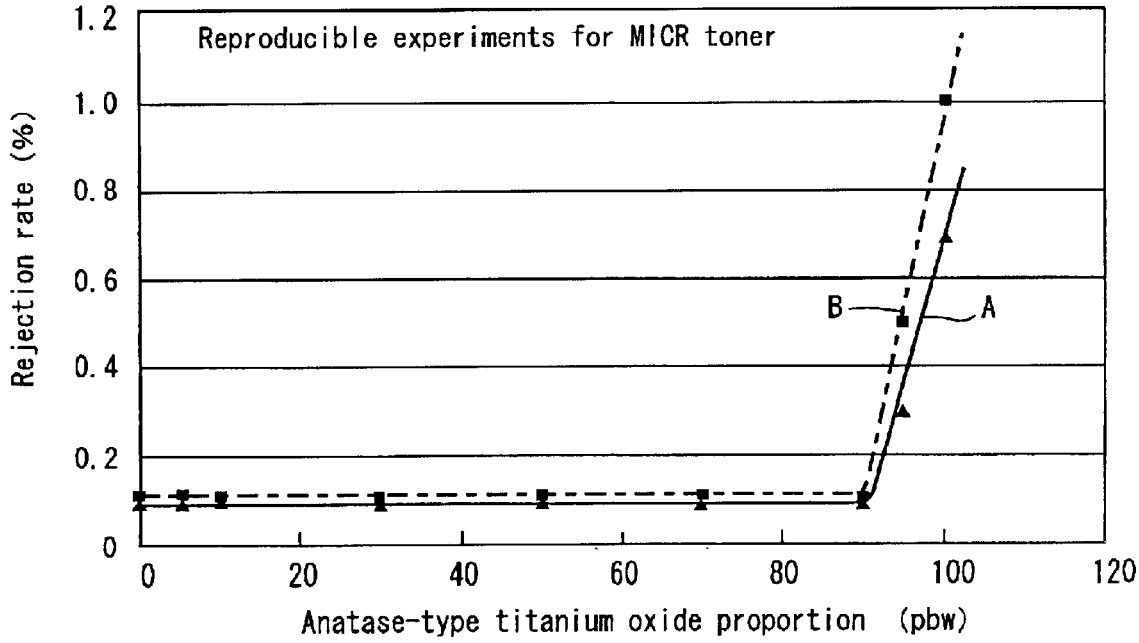
FIG. 31 shows, for a MICR toner, the relationship (in reproducibility experiments) between the (i) added proportions of anatase-type titanium oxide and rutile-type titanium oxide and (ii) the rejection rate.

On the other hand, when positive charging is performed, it is preferable for the added amount of rutile-type titanium oxide to fall in a range of 5 to 10% by weight added to the toner particles, as shown in FIGS. 20 and 21.

Second Embodiment

The second embodiment of the present invention relates to a method by which an image forming apparatus forms images using a toner. This image forming method is characterized by using an image forming apparatus that includes: an image carrier that uses a charged-type photosensitive roll; a developing means that develops the image without coming into contact with the image carrier; a transfer means for transferring an image that has been formed on the image carrier after developing; and a cleaning means for collecting toner that is left on the image carrier, and by using a toner in which toner particles including a binder resin and magnetic particles are either subjected to a first type of treatment using both anatase-type titanium oxide and rutile-type titanium oxide or a second type of treatment so that an amount of rutile-type titanium oxide in the toner falls in a range of 5 to 10% by volume added to the entire (100%) volume of the toner.

The following description focuses on the image forming apparatus that is used in this second embodiment.

1. Image Forming Apparatus (1) Construction

An image forming apparatus 1, such as that shown in FIG. 1, can be favorably used with the toner and image forming method according to the present invention. In more detail, the image forming apparatus 1 includes a charging-type photosensitive drum (the photosensitive roll) 9 that rotates clockwise when viewed as in FIG. 1. A developer 10, a transfer roller 19, a cleaning blade 13, and a charging unit 8 are arranged in the direction of rotation around this photosensitive roll 9. The developer 10 is preferably provided with a developing roller 32, the surface of which is arranged at a predetermined gap from the surface of the photosensitive roll 9, and is constructed so that an appropriate amount of toner can be supplied from a toner container 31.

An optical transfer mechanism 5 for forming dots of an image on a surface of the photosensitive roll 9 is provided at the top of the photosensitive roll 9. This optical transfer mechanism 5 is not illustrated in FIG. 1, but is preferably constructed of a polygon mirror 2 that reflects a laser formed by a laser source and an optical system 3 that directs the laser, via a reflecting mirror 4, between the charging unit 8 and the developing roller 32 to form dots of an image on a surface of the photosensitive roll 9.

A main unit 54 that houses control circuits which are for controlling the apparatus as described later is provided at the bottom of the image forming apparatus 1. A recording sheet container 55 that can be attached to and removed from the image forming apparatus 1 from the outside is provided above the main unit 54. It is preferable for the recording sheet container 55 to be equipped with a storage box 14 for storing the recording sheets before image transfer.

It is preferable for the image forming apparatus 1 to be constructed so that recording sheets that have been placed on a pressure spring 52 are transported by transport rollers 53 and 15 via channels 16 and 17 to a resist roller 18 that is provided opposite a support roller 30.

It is also preferable for the image forming apparatus 1 to be constructed with a front cover 50, which can be opened and closed, provided on the right side of the image forming apparatus 1, so that when this front cover 50 is opened, a recording sheet that is placed upon the front cover 50 is transported into the channel 17 by a transport roller 51.

A fixing unit composed of fixing rollers 23 and 24 is provided on a left side of the image forming apparatus 1, so that the fixing rollers 23 and 24 can fix an image on a recording sheet that has passed between the photosensitive roll 9 and the transfer roller 19. It is also preferable for the image forming apparatus 1 to be constructed so that after fixing, a recording sheet is passed through a channel 27 by transport rollers 25 and 26, before being placed into an image-formed recording sheet collection box 6 by rollers 28 and 29.

It is also preferable for a display unit 47 for displaying various kinds of information, an install switch 48, and a power switch 49 to be provided at the top of the image forming apparatus 1.

(2) Operation

The above image forming apparatus 1 is preferably constructed so that when the power switch 49 is switched on, a main motor (not shown in the drawings) starts to be driven, a start switch (not shown in the drawings) has the photosensitive roll 9 start to rotate in a clockwise direction, and the optical transfer mechanism 5 becomes able to form an image on the photosensitive roll 9.

The image formed on the photosensitive roll 9 is developed by the developing roller 32 of the developer 10, with the resultant toner image being transferred onto a recording sheet by the transfer roller 19. The toner image is then fixed on the recording sheet by the fixing rollers 23 and 24, and the recording sheet is transported by the rollers 25, 27, 28, and 29 to the image-formed recording sheet collection box 6.

It should be noted that the toner that is transferred by the developing roller 32 but not used to develop the image is removed from the photosensitive roll 9 by the cleaning blade 13.

As a result, when a positive charging photosensitive roll is used, it is possible to prevent the toner marking in the defined area_and blurring phenomena over the long term by forming an image with a toner that has been treated with anatase-type titanium oxide and rutile-type titanium oxide.

2. Toner

The toner that is used in this second embodiment is the same as the toner that was described in the first embodiment, so that no further explanation is given.

Note that the image forming apparatus 1 described above can be used without modification regardless of whether this toner is a latent-image developing toner or a MICR toner, with such toners only differently slightly in the kinds of materials used in their compositions.

EXAMPLES

The following describes the present invention in more detail by means of several examples. It should be obvious that these are mere examples of the invention described in this specification, and so place no particular restrictions on the scope of the present invention.

Example 1

(1) Toner Manufacture

A mixture of styrene/acrylic resin, polyethylene wax, and a charge controlling agent was mixed by melting and kneading the substances together using a twin-screw extruder so as to form the composition given below. The resultant mixture was then cooled, pulverized and categorized to form toner particles with an average particle diameter of 7 $\mu$m.

A 10/90 parts by weight mixture of anatase-type titanium oxide (with an average particle diameter of 150 nm and a volume resistivity of $5\times10^4$ Ohm-cm) and rutile-type titanium oxide (with an average particle diameter of 250 nm and a volume resistivity of $5\times10^4$ Ohm-cm) was added to the above toner particles, with the total added amount being 2% by weight added to the weight of the toner particles. In addition, 0.5% by weight of silica microparticles ($SiO_2$) was added to form the toner of example 1.

| | |
|---|---|
| A styrene/acrylic resin | 96 pbw |
| polyethylene wax | 3 pbw |
| charge controlling agent | 1 pbw |
| anatase-type titanium oxide | 0.2 pbw |
| rutile-type titanium oxide | 1.8 pbw |
| silica microparticles | 0.5 pbw |

(2) Evaluation of the Toner (i) Charging Characteristics

Five parts of the resultant toner were mixed with 100 parts by weight of a ferrite carrier, and a "blow-off type" charge-to-mass ratio measuring apparatus (made by Toshiba Chemical Corp.) was used to measure the initial value of the charge-to-mass ratio ($\mu$C/g) when frictional electrification has been performed for sixty minutes in a standard environment (20° C., 65% RH (added humidity)). An FS-1000 page printer (made by KYOCERA Corp.) that includes an OPC photosensitive roll was used to consecutively print 100,000 A4 sheets, with the "blow-off type" charge-to-mass ratio measuring apparatus then being used to measure the charge-to-mass ratio of the remaining toner as the value for the charge-to-mass ratio after an endurance test.

(ii) Image Characteristics

The image characteristics for the toner were evaluated using the FS-1000 mentioned earlier. In more detail, an image evaluation pattern was first printed in the standard environment (20° C., 65% RH) as the initial image, and the solid image density of this image was evaluated using a MacBeth reflective densitometer. At the same time, the incidence of background printing was observed using the criteria given below. After this, the FS-1000 mentioned earlier was used to consecutively print 100,000 A4 sheets, with the image evaluation pattern being used as a test image and the solid image density of this image being evaluated using a MacBeth reflective densitometer. In the same way, the incidence of background printing for the test image was observed using the criteria given below "Good": no background printing at all
"Fair": some background printing
"Bad": prominent background printing (iii) Incidence of Blurring Phenomena The incidence of blurring phenomena was also evaluated for the toner. In more detail, the FS-1000 mentioned earlier was used to consecutively print 5,000 A4 sheets in the standard environment (20° C., 65% RH). After this, the FS-1000 was left for 24 hours in a high temperature/high humidity environment (33° C., 85% RH) before printing the image evaluation pattern and evaluating the incidence of blurring phenomena through observation using the following criteria.

"Good": no blurring phenomena at all, with the image evaluation pattern being accurately reproduced
"Fair": a little blurring phenomena, with part of the image evaluation pattern not being reproduced

TABLE 1

| | Anatase-type titanium oxide | Rutile-type titanium oxide |
|---|---|---|
| Example 1 | 10 | 90 |
| Example 2 | 30 | 70 |
| Example 3 | 50 | 50 |
| Example 4 | 70 | 30 |
| Example 5 | 90 | 10 |
| Comparative Example 1 | 0 | 100 |
| Example 6 | 5 | 95 |
| Example 7 | 95 | 5 |
| Comparative Example 2 | 100 | 0 |

TABLE 2

| | Charging | | Image Characteristics | | | | |
|---|---|---|---|---|---|---|---|
| | Characteristics (μC/g) | | Image Density | | Background printing | | |
| | Initial | Post Endurance | Initial | Post Endurance | Initial | Post Endurance | Blurring Phenomena |
| Example 1 | 24.3 | 24.9 | 1.40 | 1.43 | Good | Good | Good |
| Example 2 | 25.2 | 24.7 | 1.41 | 1.42 | Good | Good | Good |
| Example 3 | 25.5 | 25.6 | 1.43 | 1.44 | Good | Good | Good |
| Example 4 | 25.3 | 25.5 | 1.42 | 1.41 | Good | Good | Good |
| Example 5 | 25.8 | 25.5 | 1.39 | 1.41 | Good | Good | Good |
| Comparative Example 1 | 25.1 | 25.5 | 1.41 | 1.39 | Good | Good | Bad |
| Example 6 | 25.5 | 25.7 | 1.40 | 1.41 | Good | Good | Fair |
| Example 7 | 35.8 | 40.5 | 1.31 | 1.24 | Fair | Bad | Good |
| Comparative Example 2 | 38.6 | 45.1 | 1.27 | 1.21 | Bad | Bad | Good |

"Bad": some incidence of prominent blurring phenomena, with the image evaluation pattern being poorly reproduced

Examples 2 to 7 and Comparative Examples 1 and 2

As shown in Table 1, other toners were formed in the same way as example 1 by varying the proportions with which anatase-type titanium oxide and rutile-type titanium oxide are added, with these toners also being evaluated. As can be understood from Table 2, the examples 2 to 5 were formed with the ratio of the added proportions of anatase-type titanium oxide and rutile-type titanium oxide in a range of 10/90 to 90/10, with the evaluation results confirming that this range of the ratio of proportions results in a toner with balanced charging characteristics, image characteristics, and susceptibility to blurring phenomena.

In example 6, the added amount of anatase-type titanium oxide is slightly less than the above range, so that some blurring phenomena was observed. Also, in example 7, the added amount of rutile-type titanium oxide is slightly less than the above range, so that in some cases there was some deterioration in the image characteristics (background printing and image density). On the other hand, in comparative example 1, anatase-type titanium oxide is not used, so that blurring phenomena was observed. In comparative example 2, rutile-type titanium oxide was not used, so that in some cases there was deterioration in the image characteristics (background printing and image density).

Examples 8 to 14 and Comparative Examples 3 and 4

As shown in Table 3, the effects of adding anatase-type titanium oxide and rutile-type titanium oxide, which have been treated with a titanate coupling agent, to a toner were evaluated in the same way as example 1. It should be noted that the anatase-type titanium oxide and rutile-type titanium oxide were subjected to a surface treatment with a titanate coupling agent using a ratio of 5 parts by weight of titanate coupling agent to 100 parts by weight of anatase-type titanium oxide or rutile-type titanium oxide.

As a result, the electrostatic latent image developing toners of the examples 8 to 14 include certain amounts of anatase-type titanium oxide and rutile-type titanium oxide that have been treated with a titanate coupling agent, so that as shown in Table 4, charging characteristics with superior durability and stability were obtained, as was superior abrasion, so that no image defects due to blurring phenomena were observed.

TABLE 3

| | Anatase-type titanium oxide treated with titanate coupling agent | Rutile-type titanium oxide treated with titanate coupling agent |
|---|---|---|
| Example 8 | 10 | 90 |
| Example 9 | 30 | 70 |
| Example 10 | 50 | 50 |
| Example 11 | 70 | 30 |

TABLE 3-continued

| | Anatase-type titanium oxide treated with titanate coupling agent | Rutile-type titanium oxide treated with titanate coupling agent |
|---|---|---|
| Example 12 | 90 | 10 |
| Comparative Example 3 | 0 | 100 |
| Example 13 | 5 | 50 |
| Example 14 | 95 | 5 |
| Comparative Example 4 | 100 | 0 |

TABLE 4

| | Charging | | Image Characteristics | | | | |
|---|---|---|---|---|---|---|---|
| | Characteristics (μC/g) | | Image Density | | Background printing | | |
| | Initial | Post Endurance | Initial | Post Endurance | Initial | Post Endurance | Blurring Phenomena |
| Example 8 | 14.0 | 13.9 | 1.42 | 1.43 | Good | Good | Good |
| Example 9 | 15.1 | 14.8 | 1.42 | 1.41 | Good | Good | Good |
| Example 10 | 15.5 | 15.6 | 1.40 | 1.41 | Good | Good | Good |
| Example 11 | 15.3 | 15.5 | 1.41 | 1.40 | Good | Good | Good |
| Example 12 | 15.8 | 15.5 | 1.41 | 1.40 | Good | Good | Good |
| Comparative Example 3 | 15.0 | 15.1 | 1.40 | 1.38 | Good | Good | Bad |
| Example 13 | 15.9 | 15.7 | 1.41 | 1.39 | Good | Good | Fair |
| Example 14 | 19.8 | 25.5 | 1.30 | 1.25 | Fair | Bad | Good |
| Comparative Example 4 | 22.5 | 30.3 | 1.28 | 1.20 | Bad | Bad | Good |

Examples 15 to 21 and Comparative Examples 5 and 6

As shown in Table 5, toners in which the added proportions of anatase-type titanium oxide and rutile-type titanium oxide with different average particle diameters are varied were evaluated in the same way as for the example 1. It should be noted that the examples 15 to 21 correspond to the reproducible experiments for examples 1 to 7.

As the electrostatic latent image developing toners of the examples 15 to 21 have varying proportions of anatase-type titanium oxide and rutile-type titanium oxide with different average particle diameters, as shown in Table 6, charging characteristics with superior durability and stability were obtained, as was superior abrasion, so that no image defects due to blurring phenomena were observed.

TABLE 5

| | Anatase-type titanium oxide | Rutile-type titanium oxide |
|---|---|---|
| Example 15 | 10 | 90 |
| Example 16 | 30 | 70 |
| Example 17 | 50 | 50 |
| Example 18 | 70 | 30 |
| Example 19 | 90 | 10 |

TABLE 5-continued

| | Anatase-type titanium oxide | Rutile-type titanium oxide |
|---|---|---|
| Comparative Example 5 | 0 | 100 |
| Example 20 | 5 | 95 |
| Example 21 | 95 | 5 |
| Comparative Example 6 | 100 | 0 |

TABLE 6

| | Charging | | Image Characteristics | | | | |
|---|---|---|---|---|---|---|---|
| | Characteristics (μC/g) | | Image Density | | Background printing | | |
| | Initial | Post Endurance | Initial | Post Endurance | Initial | Post Endurance | Blurring Phenomena |
| Example 15 | 24.1 | 24.9 | 1.42 | 1.42 | Good | Good | Good |
| Example 16 | 24.9 | 24.7 | 1.43 | 1.44 | Good | Good | Good |
| Example 17 | 25.5 | 25.1 | 1.43 | 1.42 | Good | Good | Good |
| Example 18 | 25.1 | 25.5 | 1.42 | 1.41 | Good | Good | Good |
| Example 19 | 25.8 | 25.4 | 1.41 | 1.42 | Good | Good | Good |
| Comparative Example 5 | 25.1 | 25.2 | 1.43 | 1.38 | Good | Good | Bad |
| Example 20 | 25.4 | 25.5 | 1.40 | 1.39 | Good | Good | Fair |
| Example 21 | 35.8 | 39.8 | 1.31 | 1.24 | Fair | Bad | Good |
| Comparative Example 6 | 38.1 | 45.5 | 1.27 | 1.20 | Bad | Bad | Good |

Comparative Examples 7 to 9

(1) Production of an Electrostatic Latent Image Developing Toner

As comparative example 7, the effects of a mixture of anatase-type titanium oxide with an average particle diameter of under 10 nm and rutile-type titanium oxide with an average particle diameter of under 200 nm were investigated. As comparative example 8, the effects of a mixture of anatase-type titanium oxide with an average particle diameter of under 10 nm and rutile-type titanium oxide with an average particle diameter in a range of 200 to 500 nm were investigated. Also, as comparative example 9, the effects of a mixture of anatase-type titanium oxide with an average particle diameter in a range of 10 to 200 nm and rutile-type titanium oxide with an average particle diameter of under 200 nm were investigated.

As can be understood from the results shown in Table 7, it was confirmed that an electrostatic latent image-developing toner with a favorable balance between the charging characteristics, image characteristics, and susceptibility to blurring phenomena cannot be obtained when, as in comparative example 7 to 9, anatase-type titanium oxide and rutile-type titanium oxide with the desired average particle diameters and desired proportions are not used.

TABLE 7

| | Charging | | Image Characteristics | | | | |
|---|---|---|---|---|---|---|---|
| | Characteristics (μC/g) | | Image Density | | Background printing | | |
| | Initial | Post Endurance | Initial | Post Endurance | Initial | Post Endurance | Blurring phenomena |
| Example 15 | 24.1 | 24.9 | 1.42 | 1.42 | Good | Good | Good |
| Comparative Example 7 | 25.5 | 29.8 | 1.31 | 1.25 | Fair | Fair | Good |
| Comparative Example 8 | 25.0 | 28.0 | 1.30 | 1.24 | Good | Fair | Good |
| Comparative Example 9 | 25.1 | 27.9 | 1.30 | 1.23 | Good | Fair | Good |

Examples 22 to 26 and Comparative Examples 10 and 11

As shown in Table 8, the degree of coagulation of anatase-type titanium oxide and rutile-type titanium oxide was varied so as to be 1% for both substances in example 22, 3% for both substances in example 23, 5% for both substances in example 24, 7% for both substances in example 25, and 9% for both substances in example 26, with these electrostatic image-developing toners being manufactured and evaluated in the same way as for example 1.

On the other hand, the degree of coagulation of anatase-type titanium oxide and rutile-type titanium oxide was varied so as to be 15% for both substances in comparative example 10, with the degree of coagulation of anatase-type titanium oxide being 1% and the degree of coagulation of rutile-type titanium oxide being 15% in comparative example 11, with these electrostatic latent image-developing toners being manufactured and evaluated in the same way as for example 1.

As can be understood from the results shown in Table 8 and in FIGS. 14 to 19, it was confirmed that an electrostatic latent image-developing toner with a favorable balance between the charging characteristics, image characteristics, and susceptibility to blurring phenomena is obtained when, as in examples 22 to 26, the degree of coagulation of both anatase-type titanium oxide and rutile-type titanium oxide is below 10%.

TABLE 8

| | | Charging | | Image Characteristics | | | | |
|---|---|---|---|---|---|---|---|---|
| | | Characteristics (μC/g) | | Image Density | | Background printing | | |
| | Coagulation (%) | Initial | Post Endurance | Initial | Post Endurance | Initial | Post Endurance | Blurring phenomena |
| Example 15 | 1/1 | 25.5 | 25.1 | 1.43 | 1.42 | Good | Good | Good |
| Example 16 | 3/3 | 25.1 | 24.8 | 1.42 | 1.39 | Good | Good | Good |
| Example 17 | 5/5 | 24.9 | 24.5 | 1.43 | 1.41 | Good | Good | Good |
| Example 18 | 7/7 | 24.7 | 25.1 | 1.39 | 1.38 | Good | Good | Good |
| Example 19 | 9/9 | 25.0 | 25.0 | 1.40 | 1.35 | Good | Good | Good |
| Comparative Example 5 | 15/15 | 19.8 | 15.0 | 1.29 | 1.18 | Bad | Bad | Bad |
| Comparative Example 6 | 1/15 | 21.2 | 16.0 | 1.29 | 1.20 | Bad | Bad | Bad |

N.B. Coagulation refers to the degree of coagulation of anatase-type titanium oxcide/rutile-type titanium oxide Examples 27 to 32 and Comparative Examples 12 and 13

Examples 27 to 32 were formed by varying, as shown in Table 9, the proportions of anatase-type titanium oxide and rutile-type titanium oxide that both have a degree of coagulation of 1% in the same way as in example 22. These electrostatic latent image developing toners were manufactured and evaluated in the same way as example 1.

As a result, as shown in Table 10, it was confirmed that when the degree of coagulation of both the added anatase-type titanium oxide and the added rutile-type titanium oxide is below 10% and the added proportions are adjusted, electrostatic latent image developing toners for which the charging characteristics, image characteristics, and susceptibility to blurring phenomena are even more well-balanced are obtained.

TABLE 9

| | Anatase-type titanium oxide (p b w) | Rutile-type titanium oxide (p b w) |
|---|---|---|
| Example 26 | 10 | 90 |
| Example 27 | 30 | 70 |
| Example 28 | 50 | 50 |
| Example 29 | 70 | 30 |
| Example 30 | 90 | 10 |
| Comparative Example 12 | 0 | 100 |
| Example 31 | 5 | 95 |
| Example 32 | 95 | 5 |
| Comparative Example 13 | 100 | 0 |

TABLE 10

| | Charging | | Image Characteristics | | | | |
|---|---|---|---|---|---|---|---|
| | Characteristics (μC/g) | | Image Density | | Background printing | | |
| | Initial | Post Endurance | Initial | Post Endurance | Initial | Post Endurance | Blurring Phenomena |
| Example 26 | 24.1 | 24.9 | 1.42 | 1.42 | Good | Good | Good |
| Example 27 | 24.9 | 24.7 | 1.43 | 1.44 | Good | Good | Good |
| Example 28 | 25.5 | 25.1 | 1.43 | 1.42 | Good | Good | Good |
| Example 29 | 25.1 | 25.5 | 1.42 | 1.41 | Good | Good | Good |
| Example 30 | 25.8 | 25.4 | 1.41 | 1.42 | Good | Good | Good |
| Comparative Example 12 | 25.1 | 25.2 | 1.43 | 1.38 | Good | Good | Bad |
| Example 31 | 25.4 | 25.5 | 1.40 | 1.39 | Good | Good | Fair |
| Example 32 | 35.8 | 39.8 | 1.31 | 1.24 | Fair | Bad | Good |
| Comparative Example 13 | 38.1 | 45.5 | 1.27 | 1.20 | Bad | Bad | Good |

Example 33

(1) Producing the Toner Particles

The following raw materials were mixed in a Henschel Mixer and then melted and kneaded together in a twin-screw extruder. After this, the resultant mixture was then cooled, pulverized and categorized to form a magnetic toner a with an average particle diameter of 7 μm and a bulk density of 0.60 g/cm$^3$.

| | |
|---|---|
| binder resin (St/Ac resin) | 50% by weight |
| magnetic particles (magnetite) | 40% by weight |
| charge controlling agent (quaternary ammonium salt) | 5% by weight |
| wax (polyethylene wax) | 5% by weight |

(2) Forming the Toner

According to the proportions given below, the toner particles a, rutile-type titanium oxide (hereafter "titanium oxide 1") with a bulk density of 0.40 g/cm$^3$, and silica microparticles (as a fluidity improving agent) were placed in a Henschel mixer and were mixed at a peripheral velocity of 45 m/sec for six minutes to form a toner that has been treated with 6.1% by volume of rutile-type titanium oxide.

| | |
|---|---|
| toner particles a | 100% by weight |
| silica | 1% by weight |
| titanium oxide 1 | 1.5% by weight |

(3) Evaluation of the Toner

A single-layered photosensitive roll, composed of a drum-shaped conductive substrate on which a photosensitive layer is formed by dispersing a charge production agent, an electron transporting agent, and a positive hole transporting agent in a resinous binder, is used as a positive-charging photosensitive roll. An electrostatic latent image is formed on the positive-charging photosensitive roll by evenly charging the positive-charging photosensitive roll to 400V using a scorotron charger and then exposing the positive-charging photosensitive roll to a laser with a wavelength of 780 nm and a fluence of 1.0 μJ/cm$^2$.

After this, a developing bias, composed of 300V DC on which a rectangular waveform with a duty ratio of 50%, a VPP (volts peak to peak) of 1.4 kV, and a frequency of 2.4 kHz has been superimposed, was applied to an aluminum sleeve of the developing apparatus, and the electrostatic latent image is developed using toner. At this point, the gap between the photosensitive roll and the aluminum sleeve was set at 0.3 mm.

After this, the toner that has developed the electrostatic latent image on the drum is transferred onto a recording sheet by a transfer roller to which 800 to 1200 volts DC has been applied. The residual toner on the surface of the drum is removed by a rubber blade that presses against the drum. This rubber blade is formed using urethane rubber with a hardness of 65°, and the thickness, free edge, and contact pressure of the rubber blade are adjusted so that the force applied to the photosensitive roll is 17 g/cm.

After this, the image forming apparatus described above was used to perform a printing durability test of 20,000 A4 sheets, with the stability of image density, the toner marking in the defined area, and susceptibility to blurring phenomena, and susceptibility to background printing being evaluated using the criteria given below.

(i) Image Density Stability

"Good": Fluctuations in density of within 0.2 for an initial temperature of 20° C. and an image density of 60%
"Fair": Fluctuations in density of within 0.3 for an initial temperature of 20° C. and an image density of 60%
"Bad": Fluctuations in density in excess of 0.3 for an initial temperature of 20° C. and an image density of 60[{]ps (ii) Susceptibility to Unwanted Toner Marking "Good": No unwanted toner marks observed
"Fair": Some unwanted toner marks observed, but no particular effect on image characteristics
"Bad": Prominent unwanted toner marks observed (iii) Susceptibility to Blurring Phenomena "Good": No blurring phenomena
"Fair": Some blurring phenomena occurs
"Bad": Prominent blurring phenomena occurs (iv) Susceptibility to background printing "Good": No background printing
"Fair": Some background printing occurs
"Bad": Prominent background printing occurs Comparative Example 14

As comparative example 14, the toner particles a, rutile-type titanium oxide (hereafter "titanium oxide 1") with a bulk density of 0.40 g/cm$^3$, and silica microparticles (as a fluidity improving agent) were placed according to the proportions given below in a Henschel mixer and were mixed at a peripheral velocity of 45 m/sec for six minutes to form a toner that has been treated with 2.0% by volume of rutile-type titanium oxide.

| | |
|---|---|
| toner particles (a) | 100% by weight |
| silica | 1.0% by weight |
| titanium oxide 1 | 0.5% by weight |

After this, the resultant toner was evaluated in the same way as example 33. The results of this evaluation are shown in Table 11. As can be understood from the results, in comparative example 14 only a small amount of rutile-type titanium oxide is used, so that the incidence of blurring phenomena and unwanted toner marks can be assumed to be due the effects of having added rutile-type titanium oxide not being realized.

Example 34

As example 34, the toner particles (a), rutile-type titanium oxide (hereafter "titanium oxide 2") with a bulk density of 0.65 g/cm$^3$, and silica microparticles (as a fluidity improving agent) were placed according to the proportions given below in a Henschel mixer and were mixed at a peripheral velocity of 45 m/sec for six minutes to form a toner that has been treated with 6.2% by volume of rutile-type titanium oxide.

| | |
|---|---|
| toner particles a | 100% by weight |
| silica | 1.0% by weight |
| titanium oxide 2 | 2.5% by weight |

After this, the resultant toner was evaluated in the same way as example 33. The results of this evaluation are shown in Table 11. As can be understood from the results, even when there was some change in the type of rutile-type titanium oxide, there was no decrease in image density even at high temperatures and high humidity, and no background printing even after a printing durability test of 20,000 sheets, which is thought to be due to a suitable amount of rutile-type titanium oxide having been used in example 34.

Comparative Example 15

As comparative example 15, the presrnt toner particles (a), rutile-type titanium oxide (hereafter "titanium oxide 2") with a bulk density of 0.65 g/cm$^3$, and silica microparticles (as a fluidity improving agent) were placed according to the proportions given below in a Henschel mixer and were mixed at a peripheral velocity of 45 m/sec for six minutes to form a toner that has been treated with 3.50% by volume of rutile-type titanium oxide.

| | |
|---|---|
| toner particles (a) | 100% by weight |
| silica | 1.0% by weight |
| titanium oxide 2 | 1.5% by weight |

After this, the resultant toner was evaluated in the same way as example 33. The results of this evaluation are shown in Table 11. As can be understood from the results, blurring phenomena and unwanted toner marks are present, which is thought to be due to only a small amount of rutile-type titanium oxide having been used in comparative example 15 so that the effects of adding rutile-type titanium oxide are not realized.

Comparative Example 16

As comparative example 16, the toner particles (a), rutile-type titanium oxide (hereafter "titanium oxide 2") with a bulk density of 0.65 g/cm$^3$, and silica microparticles (as a fluidity improving agent) were placed according to the proportions given below in a Henschel mixer and were mixed at a peripheral velocity of 45 m/sec for six minutes to form a toner that has been treated with 11.3% by volume of rutile-type titanium oxide.

| | |
|---|---|
| toner particles (a) | 100% by weight |
| silica | 1.0% by weight |
| titanium oxide 2 | 4.5% by weight |

After this, the resultant toner was evaluated in the same way as example 33. The results of this evaluation are shown in Table 11. As can be understood from the results, there was a decrease in image density at high temperatures and high humidity and background printing also occurred, which are thought to be due to a large amount of rutile-type titanium oxide having been used in comparative example 16.

Comparative Example 17

As comparative example 17, the toner present particles (a), anatase-type titanium oxide (hereafter "titanium oxide 3") with a bulk density of 0.37 g/cm$^3$, and silica microparticles (as a fluidity improving agent) were placed according to the proportions given below in a Henschel mixer and were mixed at a peripheral velocity of 45 m/sec for six minutes to form a toner that has been treated with 6.3% by volume of anatase-type titanium oxide.

| | |
|---|---|
| toner particles (a) | 100% by weight |
| silica | 1.0% by weight |
| titanium oxide 3 | 1.6% by weight |

After this, the resultant toner was evaluated in the same way as example 33. The results of this evaluation are shown in Table 11. As can be understood from the results, there was a decrease in image density at high temperatures and high humidity and background printing also occurred, which are thought to be due to anatase-type titanium oxide, which has a different crystalline structure, having been used in comparative example 17.

TABLE 11

| | Example 33 | Example 34 | Comparative Example 14 | Comparative Example 15 | Comparative Example 16 | Comparative Example 17 |
|---|---|---|---|---|---|---|
| Type of $TiO_2$ | Rutile | Rutile | Rutile | Rutile | Rutile | Anatase |
| $TiO_2$ (g/cm$^3$) | 0.40 | 0.65 | 0.40 | 0.65 | 0.65 | 0.37 |
| $TiO_2$ (% by vol.) | 6.1 | 6.2 | 2.0 | 3.5 | 11.3 | 6.3 |
| Image density Stability | Good | Good | Good | Good | Bad | Bad |
| Unwanted toner Marking | Good | Good | Bad | Bad | Good | Good |
| Blurring Phenomena | Good | Good | Bad | Bad | Good | Good |
| Image characteristics (Background printing) | Good | Good | Good | Good | Bad | Bad |

Example 35

(1) MICR Toner Manufacture

The effects of adding both anatase-type titanium oxide and rutile-type titanium oxide to a MICR toner were investigated. In more detail, a styrene/acrylic resin, polyethylene wax, and a charge controlling agent were melted and kneaded together using a twin-screw extruder so as to form the composition given below. The resultant mixture was then cooled, pulverized and categorized to form toner particles with an average particle diameter of 7 $\mu$m. A 10/90 parts by weight mixture of anatase-type titanium oxide (with an average particle diameter of 150 nm and a volume resistivity of $5\times10^4$ Ohm-cm) and rutile-type titanium oxide (with an average particle diameter of 250 nm and a volume resistivity of $5\times10^4$ Ohm-cm) was added to the above toner particles, with the total added amount being 2% by weight added to the weight of the toner particles. In addition, 0.5% by weight of silica microparticles ($SiO_2$) was added to form the MICR toner of example 35.

| | |
|---|---|
| A styrene/acrylic resin | 51 pbw. |
| magnetic particles (magnetite) | 45 pbw. |
| polyethylene wax | 3 pbw. |
| charge controlling agent | 1 pbw. |
| anatase-type titanium oxide | 0.2 pbw. |
| rutile-type titanium oxide | 1.8 pbw. |
| silica microparticles | 0.5 pbw. |

(2) Evaluation of the MICR Toner

The resultant MICR toner was used as a magnetic one component developing agent in an FS-3750 page printer (made by KYOCERA Corp) that includes an a-Si photosensitive roll. The initial image characteristics, durability, and susceptibility to blurring phenomena for the toner were evaluated and the charge-to-mass ratio was measured. MICR patterns were printed to form checks, and the rejection rate for 5,000 consecutive sheets was measured using a MICR reading apparatus. The results are shown Table 12.

(i) Charging Characteristics

Five parts of the resultant MICR toner were mixed with 100 parts by weight of a ferrite carrier, and a "blow-off type" charge-to-mass ratio measuring apparatus (made by Toshiba Chemical Corp.) was used to measure the initial value of the charge-to-mass ratio ($\mu$C/g) when frictional electrification has been performed for sixty minutes in a standard environment.

An FS-3750 page printer (made by KYOCERA Corp.) that includes an a-Si photosensitive roll was used to consecutively print 100,000 A4 sheets using the present MICR toner, with the charge-to-mass ratio then being measured in the same way to find the value for the charge-to-mass ratio after an endurance test.

(ii) Image Characteristics

The image characteristics for the present MICR toner were evaluated using an FS-3750 page printer (made by KYOCERA Corp.) that includes an a-Si photosensitive roll. In more detail, an image evaluation pattern was first printed in the standard environment (20° C., 65% RH) as the initial image, and the image densities of the solid pattern were evaluated using a MacBeth reflective densitometer.

Furthermore, the present MICR toner was used to consecutively print 100,000 A4 sheets, with the solid image density being printed and used as the post-endurance test images.

Susceptibility to background printing was observed using the criteria given below.

"Good": no background printing at all

"Fair": some background printing
"Bad": prominent background printing (iii) Susceptibility to Blurring Phenomena Susceptibility to blurring Phenomena was evaluated for the present MICR toner using an FS-3750 page printer (Formed by KYOCERA Corp.) that includes an a-Si photosensitive roll. In more detail, the FS-3750 was used to consecutively print 5,000 A4 sheets in the standard environment (20° C., 65% RH). After this, the FS-3570 was left for 24 hours in a high temperature/high humidity environment (33° C., 85% RH) before printing the image evaluation pattern and evaluating the incidence of blurring phenomena through observation using the following criteria.

"Good": no blurring phenomena at all, with the image evaluation pattern being accurately reproduced
"Fair": a little blurring phenomena, with part of the image evaluation pattern not being reproduced
"Bad": distinct blurring phenomena, with the image evaluation pattern being poorly reproduced (iv) Rejection Rate An FS-3750 page printer (made by KYOCERA Corp.) that includes an a-Si photosensitive roll was used to form checks on which a MICR pattern is formed using the obtained MICR toner and the rejection rate for 5,000 consecutive sheets was measured using a MICR reading apparatus. This measurement was performed both at the start of printing and after 100,000 sheets have be consecutively printed.

On the other hand, in comparative example 19, anatase-type titanium oxide is not used, so that blurring phenomena was observed. In comparative example 19, rutile-type titanium oxide was not used, resultant in a tendency for the image characteristics (background printing and image density) to deteriorate and for the rejection rate to increase.

TABLE 12

| | Anatase-type titanium oxide | Rutile-type oxide |
|---|---|---|
| Example 35 | 10 | 90 |
| Example 36 | 30 | 70 |
| Example 37 | 50 | 50 |
| Example 38 | 70 | 30 |
| Example 39 | 90 | 10 |
| Comparative Example 18 | 0 | 100 |
| Example 40 | 5 | 95 |
| Example 41 | 95 | 5 |
| Comparative Example 19 | 100 | 100 |

TABLE 13

| | Charging Characteristics (μC/g) | | Image density | | Background printing | | | Rejection Rate | |
|---|---|---|---|---|---|---|---|---|---|
| | Initial | Post endurance | Initial | Post endurance | Initial | Post endurance | Blurring phenomena | Initial | Post endurance |
| Example 35 | 14.5 | 14.1 | 1.43 | 1.44 | Good | Good | Good | 0.1 | 0.1 |
| Example 36 | 15.2 | 14.9 | 1.43 | 1.42 | Good | Good | Good | 0.1 | 0.1 |
| Example 37 | 15.9 | 15.7 | 1.40 | 1.41 | Good | Good | Good | 0.1 | 0.1 |
| Example 38 | 15.1 | 15.2 | 1.39 | 1.41 | Good | Good | Good | 0.1 | 0.1 |
| Example 39 | 15.8 | 15.6 | 1.42 | 1.40 | Good | Good | Good | 0.1 | 0.1 |
| Comparative Example 18 | 15.1 | 15.3 | 1.39 | 1.38 | Good | Good | Bad | 0.1 | 0.1 |
| Example 40 | 15.7 | 15.7 | 1.40 | 1.39 | Good | Good | Fair | 0.1 | 0.1 |
| Example 41 | 19.5 | 26.0 | 1.31 | 1.26 | Fair | Bad | Good | 0.3 | 0.5 |
| Comparative Example 19 | 23.0 | 31.5 | 1.27 | 1.21 | Bad | Bad | Good | 0.7 | 1.0 |

Examples 36 to 41 and Comparative Examples 18 to 21

(1) MICR Toner Manufacture

As shown in Table 12, MICR toners were manufactured in the same way as example 35 with the added proportions of anatase-type titanium oxide and rutile-type titanium oxide being varied.

(2) Evaluation of the MICR Toner

The obtained MICR toners were evaluated in the same way as example 35. As can be understood from the results, it was confirmed that a MICR toner with a favorable balance between the charging characteristics, image characteristics, and susceptibility to blurring phenomena is obtained when, as in examples 36 to 40, the ratio by weight expressed by Aw/Rw for anatase-type titanium oxide and rutile-type titanium oxide that have been surface-treated with a titanate coupling agent is in a range of 10/90 to 90/10.

Examples 42 to 47 and Comparative Examples 20 to 24

As shown in Table 14, the effects of adding anatase-type titanium oxide and rutile-type titanium oxide with different average particle diameters to a MICR toner were investigated. In more detail, MICR toners were formed with various different proportions of anatase-type titanium oxide (average particle diameter 150 nm and a volume resistivity of $5\times10^4$ Ohm-cm) and rutile-type titanium oxide (average particle diameter 250 nm and a volume resistivity of $5\times10^4$ Ohm-cm) of different average particle diameters, and the resultant MICR toners were evaluated in the same way as example 35.

In comparative example 22, the effects of a mixture of anatase-type titanium oxide with an average particle diameter of below 10 nm and rutile-type titanium oxide with an average particle diameter of below 200 nm were evaluated.

In comparative example 23, the effects of a mixture of anatase-type titanium oxide with an average particle diameter of below 10 nm and rutile-type titanium oxide with an average particle diameter in a range of 200 to 500 nm were evaluated. Also, in comparative example 24, the effects of a mixture of anatase-type titanium oxide with an average particle diameter in a range of 10 to 200 nm (but exclusive of 200 nm) and rutile-type titanium oxide with an average particle diameter of below 200 nm were evaluated.

It should be noted that examples 42 to 47 were also used as reproducible experiments for the examples 35 to 41.

As can be understood from the results in Table 15, it was confirmed that by using a mixture including appropriate proportions of anatase-type titanium oxide and rutile-type titanium oxide that have appropriate average particle diameters, a MICR toner with a favorable balance between charging characteristics, image characteristics and susceptibility to blurring phenomena can be obtained.

Furthermore, as can be understood from the results in Table 16, it was confirmed that when a mixture including appropriate proportions of anatase-type titanium oxide and rutile-type titanium oxide that have appropriate average particle diameters is not used, a MICR toner with a favorable balance between charging characteristics, image characteristics and susceptibility to blurring phenomena cannot be obtained.

TABLE 14

| | Anatase-type titanium oxide | | Rutile-type oxide | |
|---|---|---|---|---|
| | Added proportion | Average particle diameter | Added proportion | Average particle diameter |
| Example 42 | 10 | 150 | 90 | 250 |
| Example 43 | 30 | 150 | 70 | 250 |
| Example 44 | 50 | 150 | 50 | 250 |
| Example 45 | 70 | 150 | 30 | 250 |
| Example 46 | 90 | 150 | 10 | 250 |
| Comparative Example 20 | 0 | 150 | 100 | 250 |
| Example 46 | 5 | 150 | 90 | 250 |
| Example 47 | 95 | 150 | 5 | 250 |
| Comparative Example 21 | 100 | 150 | 0 | 250 |
| Comparative Example 22 | 50 | Under 10 | 50 | Under 200 |
| Comparative Example 23 | 50 | Under 10 | 50 | 200 to under 500 |
| Comparative Example 24 | 50 | 10 to under 200 | 50 | Under 200 |

TABLE 15

| | Charging Characteristics (μC/g) | | Image density | | Background printing | | | Rejection Rate | |
|---|---|---|---|---|---|---|---|---|---|
| | Initial | Post endurance | Initial | Post endurance | Initial | Post endurance | Blurring Phenomena | Initial | Post endurance |
| Example 42 | 14.9 | 14.3 | 1.44 | 1.43 | Good | Good | Good | 0.1 | 0.1 |
| Example 43 | 15.1 | 14.8 | 1.41 | 1.42 | Good | Good | Good | 0.1 | 0.1 |
| Example 44 | 15.7 | 15.3 | 1.42 | 1.44 | Good | Good | Good | 0.1 | 0.1 |
| Example 45 | 15.5 | 15.5 | 1.39 | 1.42 | Good | Good | Good | 0.1 | 0.1 |
| Example 46 | 15.7 | 15.6 | 1.45 | 1.41 | Good | Good | Good | 0.1 | 0.1 |
| Comparative Example 20 | 15.0 | 15.3 | 1.39 | 1.38 | Good | Good | Bad | 0.1 | 0.1 |
| Example 47 | 15.9 | 15.6 | 1.39 | 1.38 | Good | Good | Fair | 0.1 | 0.1 |
| Example 48 | 19.9 | 26.7 | 1.32 | 1.27 | Fair | Bad | Good | 0.4 | 0.6 |
| Comparative Example 21 | 23.7 | 31.9 | 1.26 | 1.20 | Bad | Bad | Good | 0.6 | 1.0 |

TABLE 16

| | Charging Characteristics (μC/g) | | Image Characteristics | | | | |
|---|---|---|---|---|---|---|---|
| | | | Image Density | | Background printing | | |
| | Initial | Post Endurance | Initial | Post Endurance | Initial | Post Endurance | Blurring Phenomena |
| Example 26 | 14.9 | 14.3 | 1.44 | 1.43 | Good | Good | Good |
| Comparative Example 12 | 15.0 | 19.8 | 1.33 | 1.27 | Fair | Fair | Good |
| Comparative Example 32 | 14.5 | 18.0 | 1.31 | 1.25 | Good | Fair | Good |
| Comparative Example 13 | 14.8 | 18.5 | 1.31 | 1.24 | Good | Fair | Good |

INDUSTRIAL APPLICABILITY

As should be clear from the preceding description, regardless of whether the toner according to the present invention is used as an electrostatic latent image developing toner or a MICR toner, the present toner is subjected to a treatment with both anatase-type titanium oxide and rutile-type titanium oxide or alternatively is treated with rutile-type titanium oxide so that the rutile-type titanium oxide forms 5 to 10% by volume when the entire volume of the toner is regarded as being 100%. As a result, the toner has highly durable and stable charging characteristics, so that images with high image quality can be reliably formed regardless of the temperature and the humidity level. Also, according to the present invention, the presence of both anatase-type titanium oxide and rutile-type titanium oxide results in the toner applying a superior abrasive force, so that image defects such as blurring phenomena can be avoided.

Furthermore, with the image forming method according to the present invention, an image forming apparatus uses a toner that has been either treated with both anatase-type titanium oxide and rutile-type titanium oxide or has been treated with rutile-type titanium oxide so that the rutile-type titanium oxide forms 5 to 10% by volume when the entire volume of the toner is regarded as being 100%. This results in highly durable and stable charging characteristics, so that images with high image quality can be reliably formed regardless of the temperature and the humidity level.

What is claimed is:

1. A toner, wherein toner particles, including a binder resin and magnetic particles, are treated with an external additive particle that is a combination of rutile-type titanium oxide and anatase-type titanium oxide, and an average particle diameter of the anatase-type titanium oxide is in a range of 10 to below 200 nm and average particle diameter of the rutile-type titanium oxide is in a range of 200 to 500 nm.

2. The toner according to claim 1, wherein a ratio by weight Aw/Rw is between 10/90 and 90/10, Aw being an added amount of the anatase-type titanium oxide and Rw being an added amount of rutile-type titanium oxide.

3. The toner according to claim 1, wherein a degree of coagulation of both of the anatase-type titanium oxide and the rutile-type titanium oxide or each is less than 10%.

4. The toner according to claim 1, wherein the anatase-type titanium oxide is treated with a titanate coupling agent.

5. The toner according to claim 1, wherein the rutile-type titanium oxide is treated with both of a titanate coupling agent and a silane coupling agent or each as a surface treatment agent.

6. The toner according to claim 1, wherein a total amount of anatase-type titanium oxide and rutile-type titanium oxide that is added falls in a range of 0.5 to 5% by weight relative to a weight of the toner particles.

7. The toner according to claim 1, wherein the external additive particle also includes silica microparticles.

8. The toner according to claim 1, wherein the binder resin has at least two molecular weight distribution peaks, when a weight-average molecular weight (Mw) of the binder resin is measured by gel permeation chromatography (GPC).

9. The toner according to claim 1, wherein a glass transition point of the binder resin is a value in a range of 55 to 70° C.

10. The toner according to claim 1, wherein the toner is one of an electrostatic latent image developing toner and MICR (magnetic ink character recognition) toner.

11. A toner, wherein toner particles, including a binder resin and magnetic particles, are treated with an external additive particle that is a combination of rutile-type titanium oxide and anatase-type titanium oxide for an organic photosensitive roll, the average particle diameter of the anatase-type titanium oxide is in a range of 10 to below 200 nm and average particle diameter of the rutile-type titanium oxide is in a range of 200 to 500 nm, and the anatase-type titanium oxide and rutile-type titanium oxide each have a volume resistivity in a range of $1\times10^4$ to $1\times10^{15}$ Ohm·cm and a ratio by weight Aw/Rw is between 10/90 and 90/10, Aw being an added amount of the anatase-type titanium oxide and Rw being an added amount of rutile-type titanium oxide.

12. The toner according to claim 11, wherein the toner is one of an electrostatic latent image developing toner and a MICR (magnetic ink character recognition) toner.

13. A toner, wherein toner particles, including a binder resin and magnetic particles, are treated with an external additive particle that is a combination of rutile-type titanium oxide and anatase-type titanium oxide for an amorphous silicon photosensitive roll, the anatase-type titanium oxide and rutile-type titanium oxide each have a volume resistivity in a range of $1\times10^1$ to $1\times10^7$ Ohm·cm.

14. The toner according to claim 13, wherein the toner is one of an electrostatic latent image developing toner and MICR (magnetic ink character recognition) toner.

* * * * *